US010358828B2

(12) United States Patent
Sharpe et al.

(10) Patent No.: US 10,358,828 B2
(45) Date of Patent: Jul. 23, 2019

(54) METHODS OF FASTENING A WALL PANEL TO A WALL, KITS, AND WALL ASSEMBLIES

(71) Applicant: ANENDA SYSTEMS INC., Vancouver (CA)

(72) Inventors: Kenneth Nathan Sharpe, Calgary (CA); Anthony Richard Belisle, Calgary (CA); Daniel Colin Meier, Vancouver (CA)

(73) Assignee: ANENDA SYSTEMS INC., Delta, British Columbia (CA)

( * ) Notice: Subject to any disclaimer, the term of this patent is extended or adjusted under 35 U.S.C. 154(b) by 0 days.

(21) Appl. No.: 16/140,423

(22) Filed: Sep. 24, 2018

(65) Prior Publication Data

US 2019/0093369 A1 Mar. 28, 2019

Related U.S. Application Data

(63) Continuation of application No. 15/374,244, filed on Dec. 9, 2016, now Pat. No. 10,087,638, which is a (Continued)

(51) Int. Cl.
*E04F 19/06* (2006.01)
*E04F 13/08* (2006.01)

(Continued)

(52) U.S. Cl.
CPC ..... *E04F 13/0828* (2013.01); *E04B 2/00* (2013.01); *E04B 2/02* (2013.01); *E04B 2/06* (2013.01);

(Continued)

(58) Field of Classification Search
None
See application file for complete search history.

(56) References Cited

U.S. PATENT DOCUMENTS 921,163 A 5/1909 Rhoads
2,073,278 A * 3/1937 Hohl ..... E04F 19/06 16/16

(Continued)

FOREIGN PATENT DOCUMENTS

CA 1059887 8/1979
CA 1089296 11/1980

(Continued)

OTHER PUBLICATIONS

Parts, 2010, 1pg.

(Continued)

*Primary Examiner* — Paola Agudelo
*Assistant Examiner* — Adam G Barlow
(74) *Attorney, Agent, or Firm* — Lewis Roca Rothgerber Christie LLP

(57) ABSTRACT

A method of fastening a wall panel to a wall, according to one illustrative embodiment, comprises coupling a retaining body to a mounting body mounted on an outer surface of the wall adjacent a side edge of the wall panel. Coupling the retaining body to the mounting body may comprise coupling a first connector on an inner surface of the retaining body to a second connector on the mounting body, and positioning a retainer on the retaining body against a retaining surface on the wall panel to fasten the wall panel to the wall. Kits and wall assemblies according to other illustrative embodiments are also disclosed.

20 Claims, 18 Drawing Sheets

Related U.S. Application Data continuation of application No. 14/886,966, filed on Oct. 19, 2015, now Pat. No. 9,546,482, which is a continuation of application No. 13/354,168, filed on Jan. 19, 2012, now Pat. No. 9,187,913.

(51) Int. Cl.

| | |
|---|---|
| ***E04B 2/00*** | (2006.01) |
| ***E04B 2/06*** | (2006.01) |
| ***E04F 13/12*** | (2006.01) |
| ***E04B 2/02*** | (2006.01) |
| ***E04C 2/52*** | (2006.01) |
| ***E04F 13/00*** | (2006.01) |

(52) U.S. Cl.

CPC ..... *E04C 2/46* (2013.01); *E04C 2/523* (2013.01); *E04F 13/007* (2013.01); *E04F 13/0803* (2013.01); *E04F 13/12* (2013.01); *E04F 19/061* (2013.01); *E04F 19/062* (2013.01); *E04F 19/064* (2013.01); *E04B 2002/0243* (2013.01); *E04B 2002/0256* (2013.01); *E04B 2002/0282* (2013.01)

(56) References Cited

U.S. PATENT DOCUMENTS

| | | | | |
|---|---|---|---|---|
| 2,363,164 | A | 10/1940 | Waller | |
| 2,363,429 | A * | 11/1944 | Lowry | E04F 19/06 52/395 |
| 2,990,650 | A * | 7/1961 | Attwood | E04D 5/143 52/395 |
| 3,038,571 | A | 6/1962 | Clements | |
| 3,073,420 | A | 1/1963 | Olsen | |
| 3,181,662 | A | 5/1965 | Maertzig, Jr. | |
| 3,397,500 | A * | 8/1968 | Watson, Jr. | E04B 2/60 52/282.1 |
| 3,930,917 | A | 1/1976 | Esakov et al. | |
| 3,956,864 | A | 5/1976 | Fung | |
| 4,040,223 | A * | 8/1977 | Hillstrom | E04F 19/06 52/235 |
| 4,180,427 | A | 12/1979 | Bertsch | |
| 4,241,552 | A * | 12/1980 | Marulic | B61D 1/04 52/282.4 |
| 4,495,741 | A | 1/1985 | Pasiecznik | |
| 4,689,930 | A * | 9/1987 | Menchetti | E04B 2/7409 52/275 |
| 4,707,894 | A * | 11/1987 | Friedwald | E04D 3/14 24/297 |
| 5,226,274 | A | 7/1993 | Sommerstein | |
| 5,239,791 | A | 8/1993 | Mills, Jr. et al. | |
| 5,678,383 | A * | 10/1997 | Danielewicz | E04D 3/06 52/235 |
| 5,737,892 | A | 4/1998 | Greenberg | |
| 5,809,709 | A * | 9/1998 | Ryan | E04B 9/303 52/222 |
| 5,987,842 | A | 11/1999 | Klein | |
| 6,185,887 | B1 | 2/2001 | Strassle | |
| 6,360,510 | B1 | 3/2002 | Woodrum et al. | |
| 6,588,165 | B1 * | 7/2003 | Wright | E04F 19/06 52/459 |
| 6,845,590 | B1 | 1/2005 | Mills, Jr. | |
| 7,404,273 | B2 | 7/2008 | Burg et al. | |
| 2004/0010998 | A1 * | 1/2004 | Turco | E04F 13/0826 52/762 |
| 2005/0229501 | A1 | 10/2005 | Grossman et al. | |
| 2006/0059808 | A1 | 3/2006 | Nguyen | |
| 2007/0245652 | A1 * | 10/2007 | Lechasseur | E04F 13/12 52/235 |
| 2008/0000176 | A1 | 1/2008 | Mandelzys et al. | |
| 2009/0044480 | A1 | 2/2009 | Bonds | |
| 2009/0094923 | A1 * | 4/2009 | Weir | E04B 1/762 52/506.01 |
| 2010/0050548 | A1 | 3/2010 | Krieger | |
| 2010/0307072 | A1 | 12/2010 | Shan et al. | |
| 2012/0255249 | A1 | 10/2012 | Singh | |

FOREIGN PATENT DOCUMENTS

| | | |
|---|---|---|
| CA | 1 197 361 | 12/1985 |
| CA | 1329690 | 5/1994 |
| CA | 2205322 | 7/2006 |
| CA | 2 549 707 | 12/2007 |
| CA | 2 602 871 | 3/2009 |
| CA | 2 674 857 | 12/2010 |
| WO | WO 02/27109 A1 | 4/2002 |
| WO | WO 2005/102004 A2 | 11/2005 |
| WO | WO 2006/036335 A2 | 4/2006 |
| WO | WO 2008/103285 A1 | 8/2008 |

OTHER PUBLICATIONS

EasyTrim brochure; www.easytrimreveals.com; available to public at least as early as Aug. 21, 2010; 48 pp.

Chown, G.A. et al.; "Construction Technology Update No. 9: Evolution of Wall Design for Controlling Rain Penetration"; NRC CNRC; Institute for Research in Construction; Dec. 1997; 6pp.

James Hardie Building Products, Inc.; "HardiePanel Vertical Siding Technical Guide: Traditional Applications for Multifamily and Light Commercial Construction"; Version 1.1; Effective Sep. 2013; 15pp.

Citadel Architectural Products, Inc.; ProCore™; Typical Details: One Piece Molding System; Revised Nov. 2006; 17pp.

Citadel Architectural Products, Inc., "Typical Details: Two Piece Molding System: Panel 15®", Form # 7.01.TD2.B Rev. 11/06, 28pp.

Citadel Architectural Products, Inc., "Typical Details: Two Piece Molding System: Panel 20®", Form # 7.04.TD.B Rev. 11/06, 28pp.

3M, "3M™ VHB™ permanent assembly tapes", 2000-2010, 34pp.

Armetco Systems, "RDX4 ACM Dry Joint Rainscreen System: Technical Manual", 18pp.

John W. McDougall Company, Inc., "Aluminum Composite Material (ACM) Wall Panels", accessed on Dec. 12, 2011, 2pp.

SAF Southern Aluminum Finishing Company. Inc., "Aluminum Extrusions—Southern Aluminum Finishing Company", 1pg.

SAF Metal Fabrication, "Series C-3000 ACM: Typical Details", Jun. 11, 2010, 1pg.

Easytrim, "ez.bump", 6pp.

Easytrim, "ez.fit & finish", 8pp.

Easytrim, "ez.horizontal trim", 2pp.

Easytrim, "ez.shingle lap", 4pp.

"Easytrim Legend", 1pg.

Easytrim, "ez.lock", 4pp.

Easytrim, "ez.plane", 5pp.

Alcoa Architectural Products, "Aluminum Composite Material Metal Wall Panels", 2008, 4pp.

SAF Panel Extrusions & Application Guide, 4pp.

Office action dated Nov. 5, 2012 in corresponding Canadian Patent Application No. 2,765,354, 2 pp.

Office action dated Feb. 7, 2013 for corresponding Canadian Patent Application No. 2,765,354, 3pp.

* cited by examiner

METHODS OF FASTENING A WALL PANEL TO A WALL, KITS, AND WALL ASSEMBLIES

CROSS-REFERENCE TO RELATED APPLICATIONS

This application a continuation of U.S. patent application Ser. No. 15/374,244, filed Dec. 9, 2016, now U.S. Pat. No. 10,087,638, which is a continuation of U.S. patent application Ser. No. 14/886,966, filed Oct. 19, 2015, which is continuation application of U.S. patent application Ser. No. 13/354,168, filed on Jan. 19, 2012, now U.S. Pat. No. 9,187,913, the contents of all of which are incorporated herein by reference.

BACKGROUND

1. Field

The invention relates generally to wall panels, and more particularly to: methods of fastening a wall panel to a wall; kits; and wall assemblies.

2. Related Art

One wall assembly includes ornamental trim between adjacent wall panels to improve the aesthetic appearance of regions between such adjacent wall panels. For example, some such ornamental trim may be plastic, or may be held in a plastic receiver mounted to the wall. In either case, the ornamental trim generally has insufficient structural strength to fasten the wall panels to the wall, and such a wall assembly generally requires fasteners such as screws through the wall panels and in the wall to fasten the wall panels to the wall. However, generally fasteners such as screws disadvantageously do not permit thermal expansion or contraction of the wall panels without causing buckling, oil-canning, or other damage to the wall panels. Further, screwing in screws through a wall panel while holding the wall panel in place against a wall is generally cumbersome and time-consuming.

Some wall assemblies include wall panels that are mounted to a wall and sealed in an effort to form a moisture barrier to keep moisture from accumulating in the wall panels, in a space between the wall panels and the wall, in the wall, or in a combination thereof. However, such moisture barriers may trap moisture, and such trapped moisture may disadvantageously cause damage to the wall panels, to the wall, or to both.

Therefore, other wall assemblies include vents or other openings to a space between wall panels and a wall to prevent trapping moisture in that space. For example, one known wall assembly permits water to flow downward under gravitational force in a space between a wall panel and a wall. An upper surface of ornamental trim below a bottom edge of the wall panel may slope downwards away from the wall to permit water from the space between the wall panel and the wall to flow downward over that surface under gravitational force away from the wall, thereby avoiding accumulation of water near the bottom edge of the wall panel. However, such ornamental trim is generally incapable of fastening the wall panel to the wall because the downwardly sloped upper surface of the ornamental trim includes no surface that could retain the wall panel against the wall.

Another wall assembly includes a channel member secured to a wall, a clamping channel member having co-planar flanges, and securing elements such as metal clips that secure the clamping channel member to the channel member secured to the wall. In such a wall assembly, the co-planar flanges of the clamping channel member may overlie and engage areas of outer faces of panel members to clamp the panel members to the channel member secured to the wall. However, the securing elements would disadvantageously be visible from an exterior of the wall unless concealed, and therefore such a wall assembly may include a strip receivable in the channel of the clamping channel member to conceal the securing elements. However, such a strip disadvantageously increases cost and complexity of such a wall assembly.

SUMMARY

In accordance with one illustrative embodiment, there is provided a method of fastening a wall panel to a wall. The method comprises coupling a retaining body to a mounting body mounted on an outer surface of the wall adjacent a side edge of the wall panel. Coupling the retaining body to the mounting body comprises: coupling a first connector on an inner surface of the retaining body to a second connector on the mounting body; and positioning a retainer on the retaining body against a retaining surface on the wall panel to fasten the wall panel to the wall.

Fastening the wall panel to the wall may comprise fastening the wall panel to the wall independently of any fastener through the wall panel.

Coupling the first connector to the second connector may comprise receiving a portion of the wall panel having the retaining surface in a retaining region defined by the retaining body and adjacent the retainer.

Receiving the portion of the wall panel in the retaining region may comprise receiving the portion of the wall panel in the retaining region with the wall panel laterally stationary relative to the wall.

The wall panel may comprise a metallic wall panel.

The wall panel may comprise a metallic composite material wall panel, which may comprise an outer metallic layer, an inner metallic layer, and a non-metallic layer between the inner and outer metallic layers.

The wall panel may comprise an aluminum composite material wall panel, which may comprise an outer aluminum layer, an inner aluminum layer, and a non-aluminum layer between the inner and outer aluminum layers.

Coupling the first connector to the second connector may comprise coupling first and second catches, on opposite lateral sides of a projection defined by the inner surface of the retaining body, to third and fourth catches respectively on the mounting body.

Positioning the retainer against the retaining surface on the wall panel may comprise positioning the retainer against a portion of an outer surface of the wall panel facing away from the wall.

Coupling the retaining body to the mounting body adjacent the side edge of the wall panel may comprise coupling the retaining body to the mounting body adjacent a bottom side edge of the wall panel.

The method may further comprise spacing the wall panel apart from the outer surface of the wall at a location spaced apart from the side edges of the wall panel.

The method may further comprise adhering, to a spacer mounted on the outer surface of the wall, an inner surface of the wall panel facing towards the wall.

The wall may be an exterior wall.

The wall may be an interior wall.

In accordance with another illustrative embodiment, there is provided a kit comprising: a wall panel having a plurality of side edges; a retaining body comprising a retainer, an inner surface, and a first connector on the inner surface; a mounting body mountable on an outer surface of a wall and comprising a second connector couplable to the first connector; and instructions to couple the first connector to the second connector when the mounting body is mounted on the outer surface of the wall adjacent one of the plurality of side edges of the wall panel such that the retainer of the retaining body retains a retaining surface on the wall panel to fasten the wall panel to the wall.

The instructions may comprise instructions to fasten the wall panel to the wall independently of any fastener through the wall panel.

The retaining body may define a retaining region adjacent the retainer of the retaining body and sized to receive a portion of the wall panel having the retaining surface when the first connector of the retaining body is coupled to the second connector.

The retaining region may have sufficient clearance to receive the portion of the wall panel without requiring lateral movement of the wall panel relative to the wall.

The wall panel may comprise a metallic wall panel.

The wall panel may comprise a metallic composite material wall panel, which may comprise an outer metallic layer, an inner metallic layer, and a non-metallic layer between the inner and outer metallic layers.

The wall panel may comprise an aluminum composite material wall panel, which may comprise an outer aluminum layer, an inner aluminum layer, and a non-aluminum layer between the inner and outer aluminum layers.

The inner surface of the retaining body may define a projection. The first connector may comprise first and second catches on respective opposite lateral sides of the projection. The second connector may comprise third and fourth catches couplable to the first and second catches respectively.

The retaining surface of the wall panel may comprise a portion of an outer surface of the wall panel facing away from the wall.

The one of the plurality of side edges of the wall panel may comprise a bottom side edge of the plurality of side edges of the wall panel.

The kit may further comprise a spacer configured to be mounted on the outer surface of the wall and configured to space the wall panel apart from the outer surface of the wall at a location spaced apart from the plurality of side edges of the wall panel.

The kit may further comprise an adhesive for adhering, to the spacer, an inner surface of the wall panel facing towards the wall.

The wall may be an exterior wall.

The wall may be an interior wall.

In accordance with another illustrative embodiment, there is provided a wall assembly comprising: a wall panel having a plurality of side edges; and a fastener assembly. The fastener assembly comprises: a retaining body comprising a retainer, an inner surface, and a first connector on the inner surface; and a mounting body mounted on an outer surface of a wall adjacent one of the plurality of side edges of the wall panel and comprising a second connector coupled to the first connector. The retainer of the retaining body retains a retaining surface on the wall panel to fasten the wall panel to the wall.

The wall panel may be fastened to the wall independently of any fastener through the wall panel.

The retaining body may define a retaining region adjacent the retainer that receives a portion of the wall panel having the retaining surface.

The retaining region may have sufficient clearance to receive the portion of the wall panel without requiring lateral movement of the wall panel relative to the wall.

The wall panel may comprise a metallic wall panel.

The wall panel may comprise a metallic composite material wall panel, which may comprise an outer metallic layer, an inner metallic layer, and a non-metallic layer between the inner and outer metallic layers.

The wall panel may comprise an aluminum composite material wall panel, which may comprise an outer aluminum layer, an inner aluminum layer, and a non-aluminum layer between the inner and outer aluminum layers.

The inner surface of the retaining body may define a projection. The first connector may comprise first and second catches on opposite lateral sides of the projection. The second connector may comprise third and fourth catches coupled to the first and second catches respectively.

The retaining surface of the wall panel may comprise a portion of an outer surface of the wall panel facing away from the wall.

The one of the plurality of side edges of the wall panel may comprise a bottom side edge of the plurality of side edges of the wall panel.

The wall assembly may further comprise a spacer mounted on the outer surface of the wall and spacing the wall panel apart from the outer surface of the wall at a location spaced apart from the plurality of side edges of the wall panel.

The wall assembly may further comprise an adhesive adhering, to the spacer, an inner surface of the wall panel facing towards the wall.

The wall may be an exterior wall.

The wall may be an interior wall.

Other aspects and features of the invention will become apparent to those ordinarily skilled in the art upon review of the following description of illustrative embodiments in conjunction with the accompanying figures.

DETAILED DESCRIPTION

Figure 1:
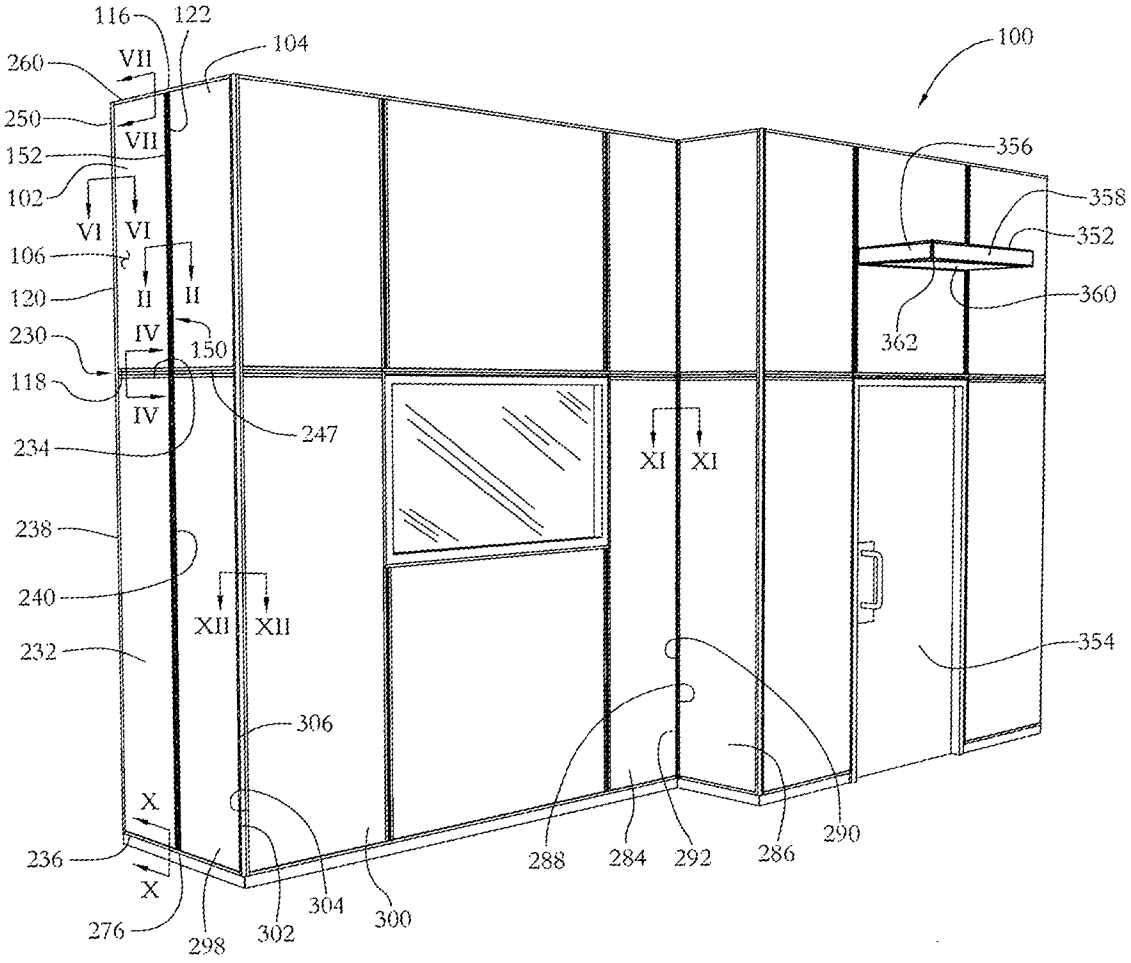
FIG. 1 is an oblique view of a wall system according to an illustrative embodiment.

Referring to FIG. 1, a wall assembly according to an illustrative embodiment is shown generally at 100. The wall assembly 100 includes various wall panels including generally coplanar wall panels 102 and 104.

Figure 2:
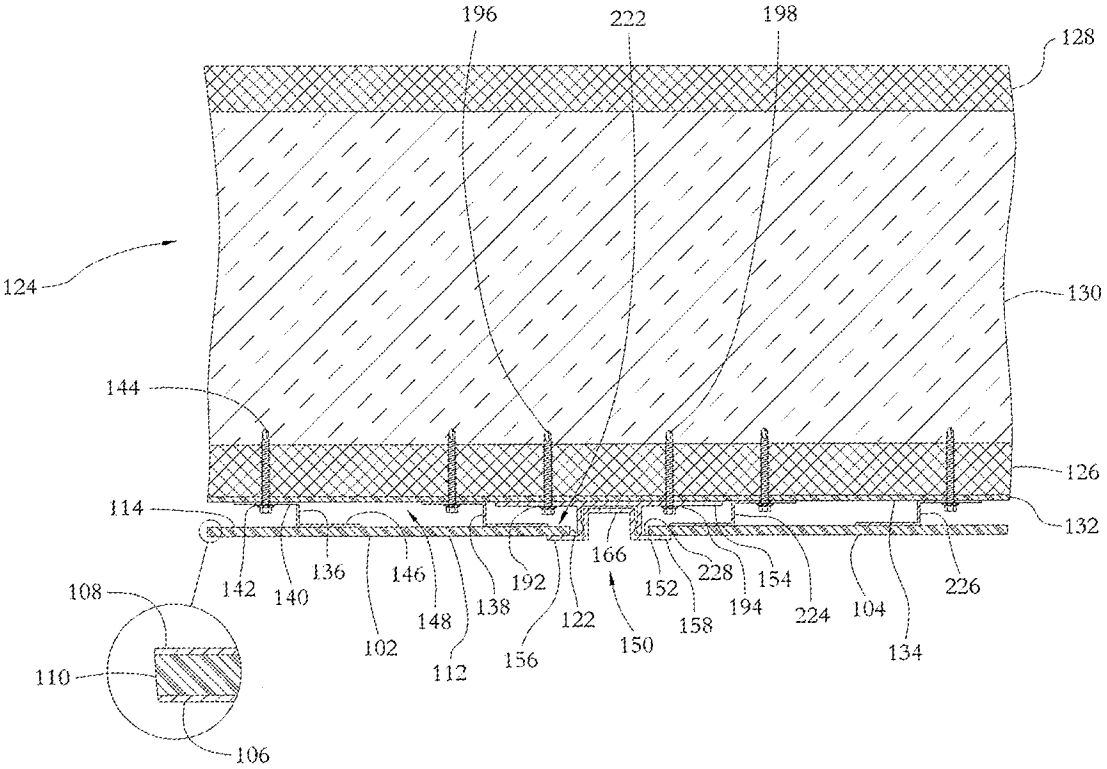
FIG. 2 is a cross-sectional view of the wall system of FIG. 1 taken along the line II-II in FIG. 1.

Referring to FIG. 2, the wall panel 102 in the embodiment shown is an aluminum composite material (ACM) wall panel including an outer aluminum layer 106, an inner aluminum layer 108, and a non-aluminum layer 110 between the inner and outer aluminum layers. The non-aluminum layer 110 in the embodiment shown is a low-density polyethylene layer, although in alternative embodiments, the non-aluminum layer may include various non-aluminum materials that may be desired for the wall panel 102. The non-aluminum layer 110 may be fire-rated in some embodiments. In general, the wall panels described herein may include a polyvinylidene fluoride (PVDF) outer coating (not shown), and such an outer coating may be applied to an aluminum coil prior to lamination into a composite panel. Such an aluminum composite material wall panel may be formed by lamination in a continuous coating process and baked at a temperature of about 390° F. to about 1,100° F. (or about 200° C. to about 600° C.). In alternative embodiments, the wall panel 102 may be metallic composite material wall panel including an outer metallic layer, an inner metallic layer, and a non-metallic layer between the inner and outer metallic layers, and in still other embodiments, the wall panel 102 may simply be a metallic wall panel or another wall panel suitable for an environment of the wall 124.

The wall panel 102 has an outer surface 112 (which in the embodiment shown is on the outer aluminum layer 106, or which may be on a PVDF outer coating in embodiments having an outer PVDF coating) and an inner surface 114 (which in the embodiment shown is on the inner aluminum layer 108). The outer surface 112 may be colored, or more generally may have a chosen aesthetic appearance such as metalics or pearls, or a brushed finish, for example. Further, as shown in FIGS. 1 and 2, the wall panel 102 has a top side edge 116, a bottom side edge 118, a left side edge 120, and a right side edge 122, all of which may more generally be referred to as "a plurality of side edges".

The wall panel 102 is fastened to a wall shown generally at 124 in FIG. 2 such that the outer surface 112 of the wall panel 102 faces away from the wall 124 and the inner surface 114 of the wall panel 102 faces towards the wall 124. The wall 124 in the embodiment shown is on an exterior of a building, and is thus an exterior wall. The wall 124 in the embodiment shown includes an outer plywood panel 126, an inner plywood panel 128, an insulating layer 130 between the inner and outer plywood panels, and a building wrap 132 on an outer surface of the outer plywood panel 126. The building wrap 132 may include tarpaper, a material known as DUPONT™ TYVEK™, or any other material that may be suitable for the wall 124. The wall 124 has an outer surface 134, which in the embodiment shown is on the building wrap 132. However, alternative embodiments may include different walls such as interior walls on an interior of a building, for example, and walls in alternative embodiments may or may not include building wrap, and may include oriented strand board, concrete, or metal-stud walls as described below, for example. The wall panel 104 is substantially the same as the wall panel 102 except that the wall panels 102 and 104 may be cut to different respective sizes to fit in the wall assembly 100.

In the embodiment shown, spacers 136 and 138 are mounted on the outer surface 134 of the wall 124. For example, spacers such as the spacers 136 and 138 may be installed about 12 inches to about 18 inches (or about 30 cm to about 45 cm) apart. Also, some illustrative embodiments include at least two such spacers for each wall panel, and in some embodiments two middle spacers may be spaced about 8 inches (or about 20 cm) from each other. The spacer 136 includes an elongate body having a mounting flange 140 defining through-holes such as the through-hole 142 to receive respective fasteners such as the fastener 144 in the through-hole 142, and the spacer 136 is thus configured to be mounted on the outer surface 134 of the wall 124.

The fastener 144 in the embodiment shown is a #12 plated screw, although alternative embodiments may include alternative fasteners. For example, in some illustrative embodiments, fasteners known as "Leland Industries Master Driller™ mini drill point fasteners" with EPDM (ethylene propylene diene monomer (M-class) rubber) washers and a DT1700 coating may be suitable. In some illustrative embodiments, wood fasteners should fully penetrate sheathing of the wall, with the point of the screw not included.

Although the fastener 144 is shown received in the outer plywood panel 126, the fastener 144 and other fasteners described herein may also be received in wood studs or other structural parts of a wall, for example. In some illustrative embodiments, such fasteners may be spaced about 8 inches (or about 20 cm) from each other along the mounting flange of the spacer, although such spacing may depend on factors such as design wind pressure as discussed below.

The spacer 136 also includes a contact flange 146 extending parallel to and spaced apart from the mounting flange 140. The contact flange contacts the inner surface 114 of the wall panel 102 and spaces the wall panel 102 apart from the outer surface 134 of the wall 124 at a location spaced apart from the side edges 116, 118, 120, and 122 of the wall panel 102 to define a space shown generally at 148 between the inner surface 114 of the wall panel 102 and the outer surface 134 of the wall 124. In the embodiment shown, the contact flange 146 is adhered to the inner surface 114 of the wall panel 102 with an acrylic or rubberized two-sided adhesive tape known as "3M™ VHB™ permanent assembly tape". However, in alternative embodiments, the contact flange 146 may be adhered to the inner surface 114 of the wall panel 102 with one or more different adhesives, or the contact flange 146 may not be adhered to the inner surface 114 of the wall panel 102. In some embodiments, only two middle spacers have adhesive on their contact flanges and other spacers do not have adhesive on their contact flanges but instead function only as spacers. The spacer 136 is substantially the same as the spacer 138. Further, spacers 224 and 226, which are substantially similar to the spacers 136 and 138, may be mounted to the outer surface 134 of the wall 124 to space the space the wall panel 104 apart from the outer surface 134 of the wall 124.

In the embodiment shown, the spacers 136 and 138 have mounting flanges (such as the mounting flange 140) on left sides of the spacers 136 and 138 when viewed in FIG. 2, whereas the spacers 224 and 226 have mounting flanges on right sides of the spacers 224 and 226 when viewed in FIG. 2. In general, spacers such as the spacers described herein may be mounted in various alternative orientations that are not limited to the orientations shown in the drawings.

Figure 3:
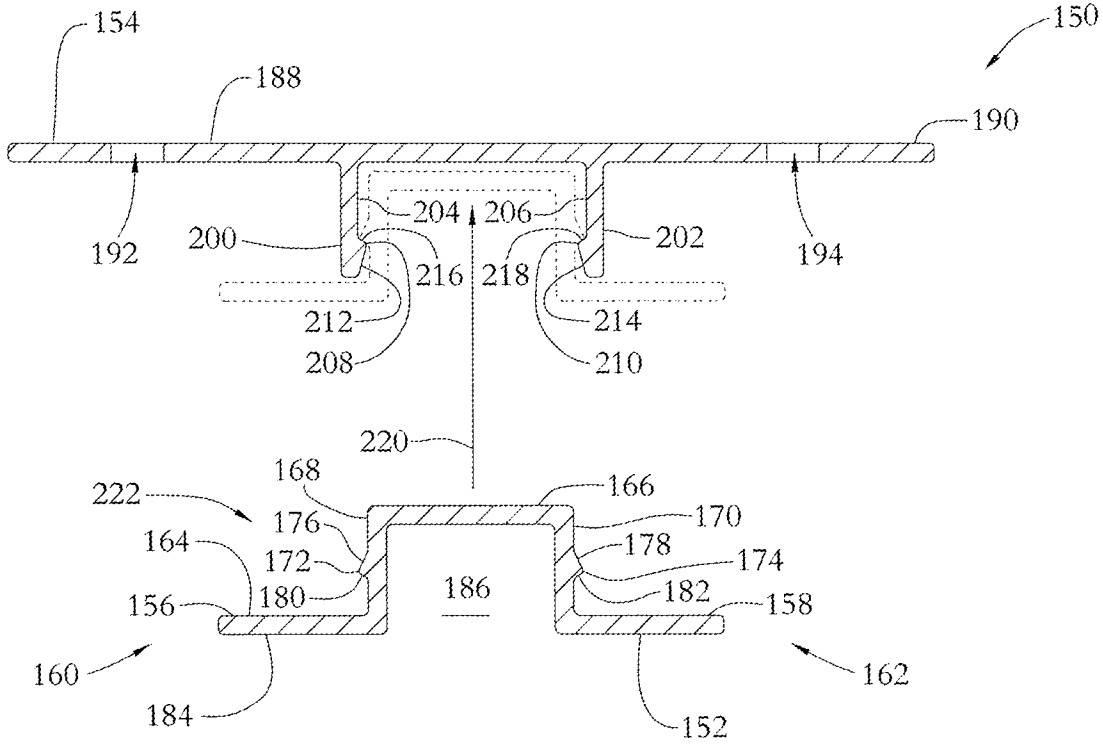
FIG. 3 is a cross-sectional view of a fastener assembly of the wall system of FIG. 1 taken along the line II-II in FIG. 1.

Referring to FIGS. 1 and 3, a fastener assembly shown generally at 150 fastens the wall panel 102 to the wall 124. The fastener assembly 150 includes a retaining body 152 and a mounting body 154. The retaining body 152 includes an elongate body having retainers 156 and 158, which in the embodiment shown are coplanar flanges extending out to opposite lateral sides shown generally at 160 and 162 respectively of the retaining body 152.

The retaining body 152 also has an inner surface 164 facing the wall 124, and the inner surface 164 defines a projection 166 projecting away from the inner surface 164 and towards the wall 124 shown in FIG. 2. The projection has opposite lateral sides surfaces 168 and 170 on the opposite lateral sides 160 and 162 respectively, and the inner surface 164 defines catches 172 and 174 on the opposite lateral sides surfaces 168 and 170 respectively. The catches 172 and 174 include respective inward-facing tapered surfaces 176 and 178 and respective outward-facing tapered catching surfaces 180 and 182.

The retaining body 152 also has an outer surface 184 opposite the inner surface 164, and the outer surface 184 defines a channel 186 recessed in the projection 166. The retaining body 152 in the embodiment shown is an aluminum extrusion cut to a desired length, although alternative embodiments may include retaining bodies formed of other materials having sufficient structural strength to fasten the panels 102 and 104 to the wall 124, such as non-metallic or synthetic materials for example, and by methods other than extrusion.

The mounting body 154 in the embodiment shown includes an elongate body having coplanar mounting flanges 188 and 190 on opposite lateral sides of the mounting body and each defining through-holes such as the through-holes shown generally 192 and 194 to receive respective fasteners such as the fastener 196 and 198 respectively, as shown in FIG. 2. The mounting body 154 is thus mountable on the outer surface 134 of the wall 124. The fasteners 196 and 198 in the embodiment shown are #12 plated screws, although alternative embodiments may include alternative fasteners. As shown in FIG. 2, the mounting body 154 in the embodiment shown is mounted on the outer surface 134 of the wall 124 adjacent the right side edge 122 of the wall panel 102. The right side edge 122 of the wall panel 102 and a left side edge 228 of the wall panel 104 are spaced apart from the mounting body 154 to allow for thermal expansion of the wall panels 102 and 104, but even with such spacing the right side edge 122 of the wall panel 102 and the left side edge 228 of the wall panel 104 may be considered to be "adjacent" the mounting body 154.

In some embodiments, the fasteners 196 and 198 may include drill-point screws and such drill-point screws may drill the through-holes 192 and 194 when the mounting body 154 is mounted to the wall 124. In some alternative embodiments, the through-holes may be machined before the mounting body 154 is mounted to the wall 124. More generally, the through-holes on the mounting flanges described herein may be drilled by drill-point screws or machined, for example.

Referring back to FIG. 3, the mounting body 154 in the embodiment shown includes laterally opposite projections 200 and 202 having respective inward-facing surfaces 204 and 206 that define respective inward-facing catches 208 and 210. The catches 208 and 210 include respective outward-facing tapered surfaces 212 and 214 and respective inward-facing tapered catching surfaces 216 and 218. The mounting body 154 in the embodiment shown is also an aluminum extrusion cut to a desired length, although alternative embodiments may include mounting bodies formed of other materials having sufficient structural strength to fasten the panels 102 and 104 to the wall 124, such as non-metallic or synthetic materials for example, and by methods other than extrusion.

The catches 172, 174, 208, and 210 are positioned such that when the retaining body 152 is urged in a direction shown by the arrow 220 towards the mounting body 154, using a rubber mallet for example, the tapered surface 176 contacts the tapered surface 212 and the tapered surface 178 contacts the tapered surface 214. The tapered surfaces 176, 178, 212, and 214 are positioned such that such contact resiliently deforms one or both of the retaining body 152 and the mounting body 154 to allow the catches 172 and 174 to pass behind the catches 208 and 210 respectively. Once the catches 172 and 174 to pass behind the catches 208 and 210 respectively, the tapered catching surfaces 180 and 182 are retained behind the tapered surfaces 216 and 218 respectively such that the catches 172 and 174 are coupled to the catches 208 and 210, as shown in dashed lines in FIG. 3. The catches 172 and 174 are thus couplable to the catches 208 and 210, and the retaining body 152 is thus coupled or couplable to the mounting body 154.

In other words, the catches 172 and 174 function as a first connector on the retaining body 152, the catches 208 and 210 function as a second connector on the mounting body 154, and when the retaining body 152 is coupled to the mounting body 154 as shown in dashed lines in FIG. 3, the first connector is coupled to the second connector. The first connector is thus couplable to the second connector.

Referring to FIGS. 2 and 3, the retaining body 152 defines a retaining region shown generally at 222 and that is adjacent the retainer 156. As indicated above, the mounting body 154 in the embodiment shown is mounted on the outer surface 134 of the wall 124 adjacent the right side edge 122 of the wall panel 102. Further, the retainer 156 is positioned on the retaining body 152 such that when the retaining body 152 is coupled to the mounting body 154, or when the first connector of the retaining body 152 is coupled to the second connector of the mounting body 154, the retainer 156 contacts a retaining surface of the wall panel 102, which in the embodiment shown is a portion of the outer surface 112 of the wall panel 102.

Therefore, in the embodiment shown, coupling the retaining body 152 to the mounting body 154, or coupling the first connector of the retaining body 152 to the second connector of the mounting body 154, inherently causes the retainer 156 to be positioned against the retaining surface of the wall panel 102. Further, as indicated above, the mounting body 154 is mounted on the outer surface 134 of the wall 124, and therefore once the retaining body 152 is coupled to the mounting body 154, or once the first connector of the retaining body 152 is coupled to the second connector of the mounting body 154, the retainer 156 can retain the retaining surface of the wall panel 102 and fasten the wall panel 102 to the wall 124.

Accomplishing such fastening when coupling the retaining body 152 to the mounting body 154 may permit fastening the wall panel 102 to the wall 124 independently of any fasteners such as screws through the wall panel 102, and therefore may advantageously permit fastening the wall panel 102 to the wall 124 in fewer steps than when compared to other methods of fastening a wall panel to a wall. Further, fastening the wall panel 102 to the wall 124 independently of any fasteners such as screws through the wall panel 102 may advantageously avoid problems such as buckling and oil-canning that may arise due to thermal expansion or contraction of a wall panel fastened using fasteners such as screws.

In the embodiment shown, the retaining region 222 is sized to receive, and receives, a portion of the wall panel 102 having the retaining surface of the wall panel 102 when the retaining body 152 is coupled to the mounting body 154 or when the first connector of the retaining body 152 is coupled to the second connector of the mounting body 154. Further, the retaining body 152 does not define any structure that would contact the wall panel 102 as the portion of the wall panel 102 is thus received in the retaining region 222. In other words, the retaining region 222 includes sufficient clearance that the retaining region can receive the portion of the wall panel 102 without requiring any lateral movement of the wall panel 102 relative to the wall 124, namely movement substantially parallel to the outer surface 112.

However, in the embodiment shown, the spacers such as the spacers 136 and 138 space the wall panel 102 sufficiently far away from the outer surface 134 of the wall 124 such that when the retaining body 152 is coupled to the mounting body 154 or when the first connector of the retaining body 152 is coupled to the second connector of the mounting body 154, the retainer 156 is positioned tightly against the retaining surface of the wall panel 102 and may slightly deform the wall panel 102 by displacing the retaining surface of the wall panel 102 slightly in the direction of the arrow 220. Therefore, in the embodiment shown, although the retaining region 222 includes sufficient clearance that the retaining region can receive the portion of the wall panel 102 without requiring any lateral movement of the wall panel 102 relative to the wall 124, the wall panel 102 may still move in the direction of the arrow 220 in response to the tight fit of the retainer 156 is positioned tightly against the retaining surface of the wall panel 102.

Referring back to FIG. 1, the wall assembly 100 also includes a fastener assembly shown generally at 230 below the wall panel 102, and a wall panel 232 below the fastener assembly 230 and generally coplanar with the wall panel 102. The wall panel 232 has a top side edge 234, a bottom side edge 236, a left side edge 238, and a right side edge 240 and is substantially the same as the wall panel 102 but may be cut to a different size to fit in the wall assembly 100.

Figure 4:
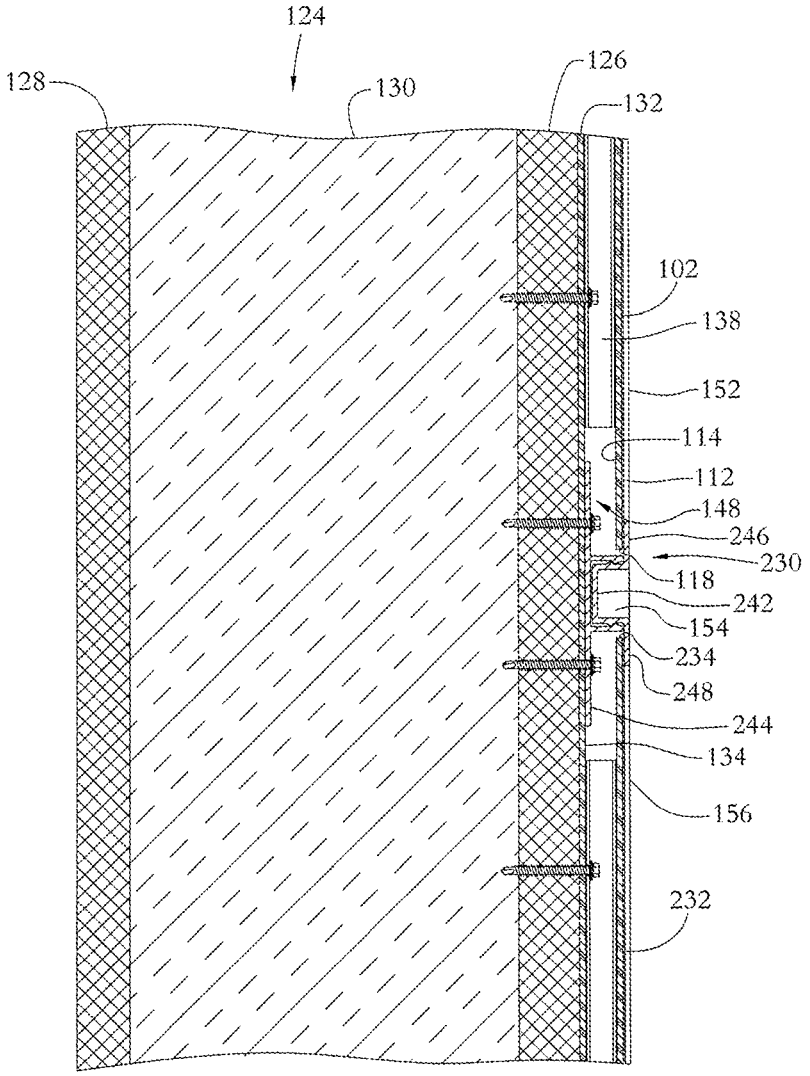
FIG. 4 is a cross-sectional view of the wall system of FIG. 1 taken along the line IV-IV in FIG. 1.

Referring to FIG. 4, the fastener assembly 230 includes a retaining body 242 and a mounting body 244, which are substantially the same as the retaining body 152 and the mounting body 154 respectively, except that the retaining body 242 and the mounting body 244 may be cut to different respective sizes to fit in the wall assembly 100. The retaining body 242 and the mounting body 244 extend generally horizontally and the mounting body 244 is mounted to the outer surface 134 of the wall 124 adjacent the bottom side edge 118 of the wall panel 102 and adjacent the top side edge 234 of the wall panel 232 such that a retainer 246 of the retaining body 242 retains a retaining surface of the wall panel 102 and a retainer 248 of the retaining body 242 retains a retaining surface of the wall panel 232 substantially as described above. Again, "adjacent" in this context includes a space to permit thermal expansion of the wall panels 102 and 232. However, in other embodiments, the bottom side edge 118 of the wall panel 102 may contact the mounting body 244 to transfer some or all of the weight of the wall panel 102 onto the mounting body 244. In such embodiments, thermal expansion and contraction may be accommodated at spaces surrounding the other side edges of the wall panel 102. In some illustrative embodiments, horizontal mounting bodies may have lengths of about 6 inches (or about 15 cm) with horizontal gaps (not shown) of about 1.5 inches (or about 4 cm) to permit any moisture that may accumulate in a space a wall panel and an outer surface of a wall 124 to exit that space.

Figure 5:
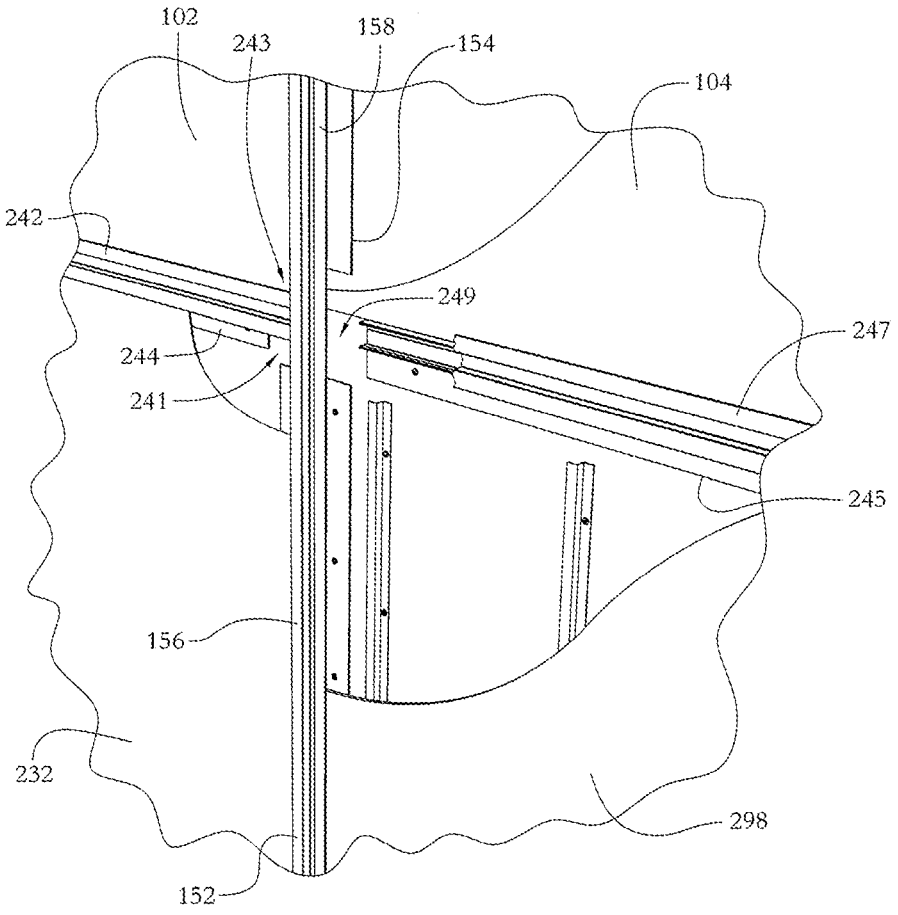
FIG. 5 is an enlarged cut-away oblique view of the wall system of FIG. 1.

Referring to FIG. 5, the mounting body 244 in the embodiment shown is cut to a length to leave a lateral space shown generally at 241 between the mounting body 244 and the retainer 156 of the retaining body 152. The lateral space 241 allows the retaining body 242 to be curved slightly such that an end shown generally at 243 of the retaining body 242 is received against the inner surface 164 (shown in FIG. 3) of the retaining body 152 and under the retainer 156. By receiving the end 243 under the retainer 156, the retaining body 242 need not be cut to a precise length that would abut the end 243 against the retainer 156. As another example, FIG. 5 illustrates a mounting body 245 that is substantially the same as the mounting body 244, and a retaining body 247 that is substantially the same as the retaining body 242. Again, the mounting body 245 is cut to a length to leave a lateral space shown generally at 249 between the mounting body 245 and the retainer 158 of the retaining body 152 to allow the retaining body 247 to be curved slightly such that an end (not shown) of the retaining body 247 may be received under the retainer 158 of the retaining body 152.

More generally, the horizontal mounting bodies described herein (such as the mounting bodies 244 and 245 shown in FIG. 5) may be laterally spaced from adjacent retainers of vertical retaining bodies (such as the retainers 152 and 158 of the retaining body 152 shown in FIG. 5) to permit ends of horizontal retaining bodies (such as the retaining bodies 242 and 247 shown in FIG. 5) to be received under the retainers of the vertical retaining bodies (such as the retainers 152 and 158 of the retaining body 152 shown in FIG. 5).

Figure 18:
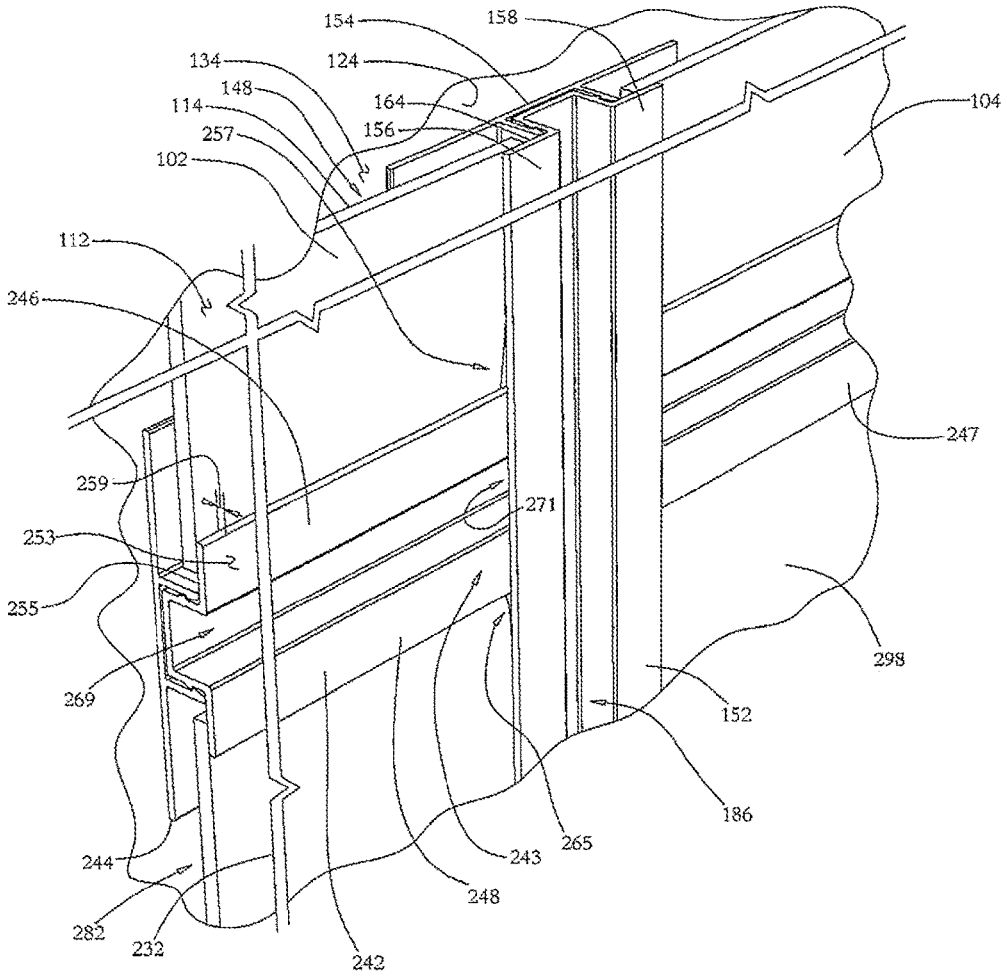
FIG. 18 is another enlarged cut-away oblique view of the wall system of FIG. 1.

Referring to FIG. 18, the end 243 of the retaining body 242 is shown against the inner surface 164 of the retaining body 152 and under the retainer 156 as described above. Therefore, an outer surface 253 of the retainer 246 is against the inner surface 164 of the retaining body 152 and under the retainer 156, and an inner surface 255 of the retainer 246 (opposite the outer surface 253) contacts a portion of the outer surface 112 of the wall panel 102. Therefore, the retainer 246 is positioned between the outer surface 112 of the wall panel 102 and the retainer 156, and the retainer 246 causes the outer surface 112 of the wall panel 102 to be separated from the inner surface of the retainer 156 at a gap shown generally at 257. Where the outer surface 112 of the wall panel 102 contacts the retainer 246, the gap 257 has a width equal to a thickness 259 of the retainer 246, but the width of the gap 257 diminishes with distance from the retainer 246 until eventually the outer surface 112 of the wall panel 102 contacts the inner surface of the retainer 156. In the embodiment of FIG. 18, contact between the outer surface 112 of the wall panel 102 and the inner surface of the retainer 156 may limit moisture from entering the air space 148 between the outer surface 134 of the wall 124 and the inner surface 114 of the wall panel 102, while the gap 257 may allow moisture to escape the air space 148 by passing between the retainer 156 and the outer surface 112 of the wall panel 102.

Likewise, the outer surface of the wall panel 232 is separated from the inner surface of the retainer 156 at a gap shown generally at 265, and contact between the retainer 156 and the outer surface of the wall panel 232 may limit moisture from entering an air space shown generally at 282 between the outer surface 134 of the wall 124 and the inner surface of the wall panel 232, while the gap 265 may allow moisture to escape the air space 282 by passing between the retainer 156 and the outer surface of the wall panel 232.

The retaining body 242 also defines a channel shown generally at 269, which is substantially the same as the channel 186, and which faces away from the wall 124. At the end 243 of the retaining body 242, the channel 269 extends under the retainer 156 and defines an opening shown generally at 271 between the retainers 246 and 248 and behind the retainer 156. The opening 271 is in fluid communication with the air spaces 148 and 282 and may also allow moisture to escape the air spaces 148 and 282.

Figure 6:
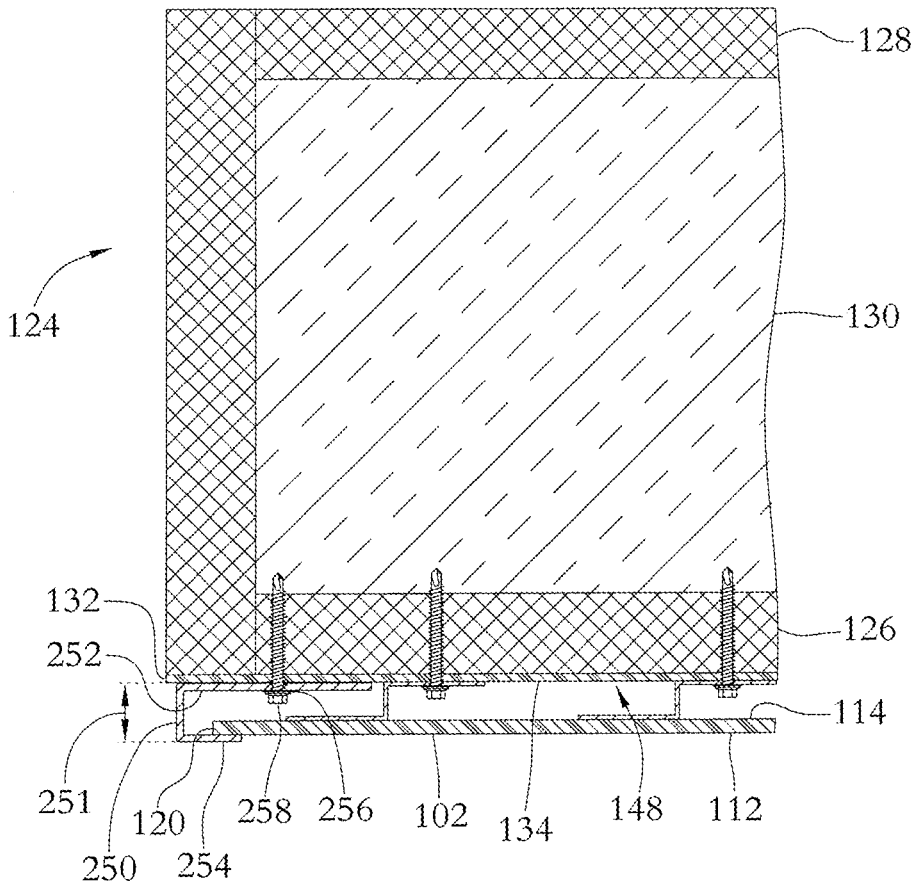
FIG. 6 is a cross-sectional view of the wall system of FIG. 1 taken along the line VI-VI in FIG. 1.

Referring to FIGS. 1 and 6, the wall assembly 100 further includes a fastening body 250 including an elongate body having a mounting flange 252 and a retainer 254, which in the embodiment shown is a flange that is generally parallel to and spaced apart from the mounting flange 252. The mounting flange defines through-holes such as the through-hole 256 to receive respective fasteners such as the fastener 258 in the through-hole 256, and the fastening body 250 is thus mounted on the outer surface 134 of the wall 124 adjacent the left side edge 120 of the wall panel 102. Again, "adjacent" in this context includes a space to permit thermal expansion of the wall panel 102. The fastener 258 in the embodiment shown is a #12 plated screw, although alternative embodiments may include alternative fasteners. As shown in FIG. 6, the retainer 254 contacts a retaining surface of the wall panel 102, which in the embodiment shown is a portion of the outer surface 112, to fasten the wall panel 102 to the wall 124. The wall panel 232 may be mounted to the wall substantially as described above for the wall panel 102.

The fastening body 250 in the embodiment shown is also an aluminum extrusion cut to a desired length, although alternative embodiments may include mounting bodies formed of other materials having sufficient structural strength to fasten the panel 102 to the wall 124, such as non-metallic or synthetic materials for example, and by methods other than extrusion.

Figure 7:
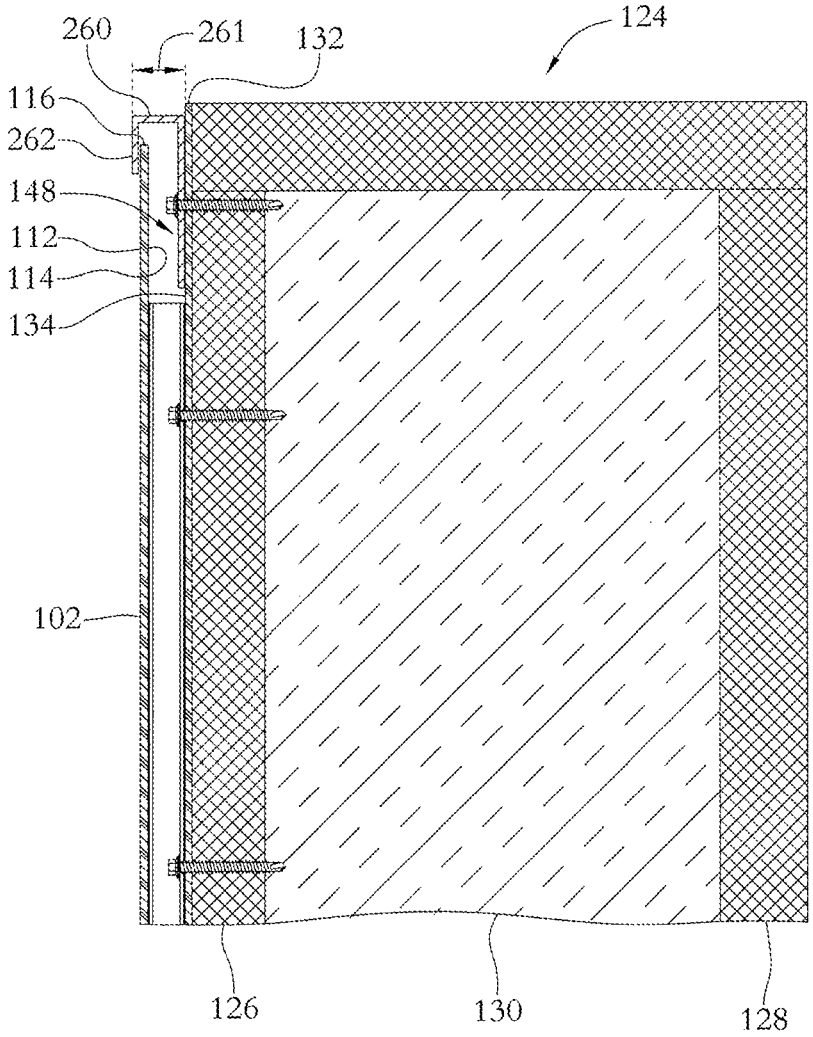
FIG. 7 is a cross-sectional view of the wall system of FIG. 1 taken along the line VII-VII in FIG. 1.

Referring to FIGS. 1 and 7, the wall assembly 100 further includes a fastening body 260 that is substantially the same as the fastening body 250. However, the fastening body 260 in the embodiment shown has a width 261 that is less than a width 251 of the fastening body 250 (shown in FIG. 6) to allow the horizontal fastening body 260 to fit under the retainer 254 (shown in FIG. 6) of the fastening body 250 (shown in FIG. 6). More generally, in the embodiment shown, horizontal retaining bodies and fastening bodies are received under retainers of vertical retaining bodies and fastening bodies. However, in alternative embodiments, horizontal retaining bodies and fastening bodies may abut retainers of vertical retaining bodies and fastening bodies, or vertical retaining bodies and fastening bodies may be received under retainers of horizontal retaining bodies and fastening bodies, for example.

Further, the fastening body 260 is cut to a desired length to fit in the wall assembly 100 and is mounted on the outer surface 134 of the wall 124 adjacent the top side edge 116 of the wall panel 102. Again, "adjacent" in this context includes a space to permit thermal expansion of the wall panel 102. The fastening body 260 has a retainer 262, which in the embodiment shown is a flange that contacts a retaining surface of the wall panel 102, which in the embodiment shown is a portion of the outer surface 112, to fasten the wall panel 102 to the wall 124.

Figure 8:
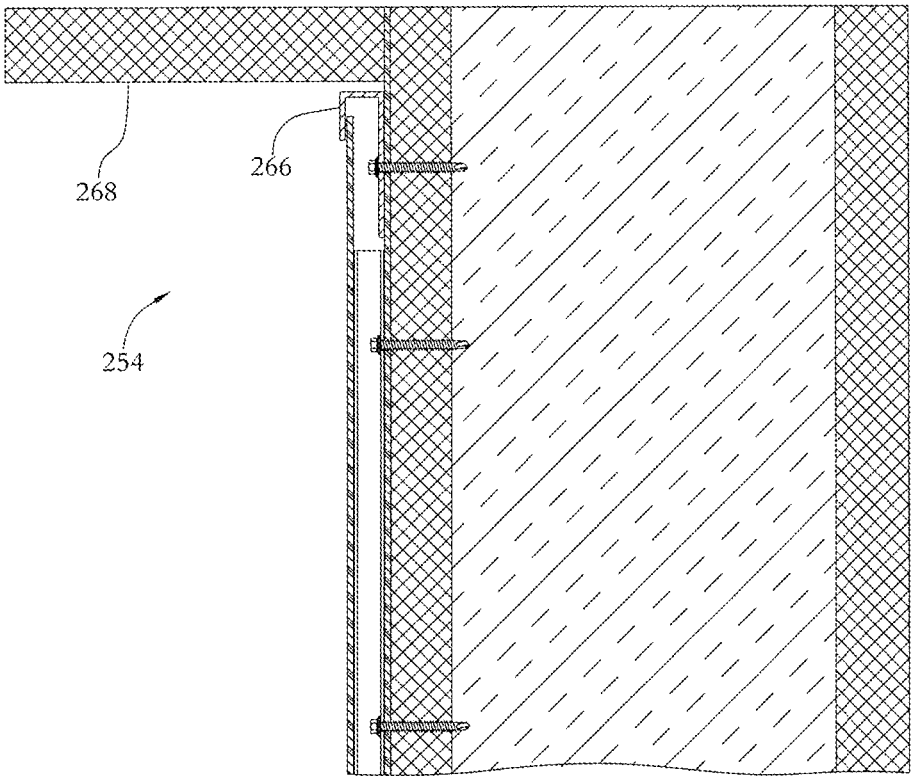
FIG. 8 is a cross-sectional view of a wall system according to another illustrative embodiment.

Referring to FIGS. 1 and 8, a wall assembly in another illustrative embodiment is shown generally at 264 and is substantially the same as the wall assembly 100. The wall assembly 264 includes a fastening body 266 that is substantially the same as the fastening body 260 but that is mounted near a soffit 268. The wall assembly 264 may thus be mounted to a wall below the soffit 268.

Figure 9:
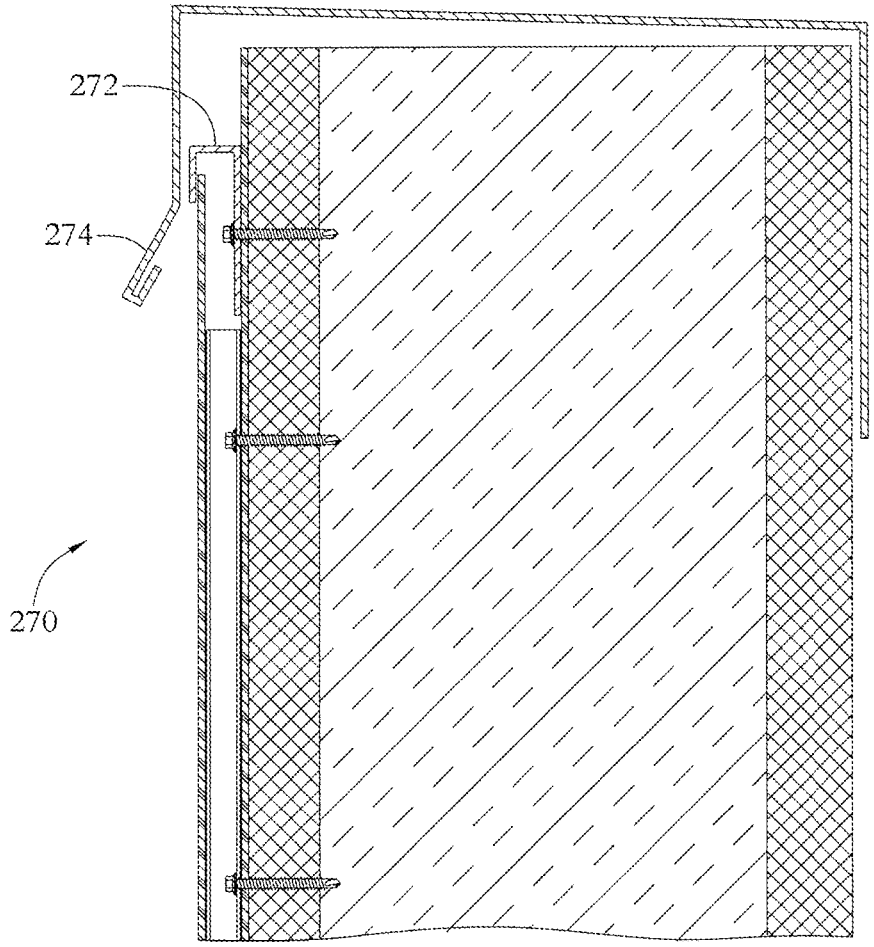
FIG. 9 is a cross-sectional view of a wall system according to another illustrative embodiment.

Referring to FIGS. 1 and 9, a wall assembly in another illustrative embodiment is shown generally at 270 and is substantially the same as the wall assembly 100. The wall assembly 270 includes a fastening body 272 that is substantially the same as the fastening body 260 but that is mounted within a parapet 274. The wall assembly 270 may thus be mounted to a wall below the parapet 274.

However, referring back to the illustrative embodiment shown in FIGS. 1 to 7, a method of fastening the wall panel 102 to the wall 124 may include:

1. mounting the mounting body 154 to the outer surface 134 of the wall 124 in a position to be adjacent the right side edge 122 of the wall panel 102;
2. mounting the mounting body 244 to the outer surface 134 of the wall 124 in a position to be adjacent the bottom side edge 118 of the wall panel 102;
3. mounting the fastening body 250 to the outer surface 134 of the wall 124 in a position to be adjacent the left side edge 120 of the wall panel 102;
4. mounting the fastening body 260 to the outer surface 134 of the wall 124 in a position to be adjacent the top side edge 116 respectively of the wall panel 102;
5. mounting various spacers such as the spacers 136 and 138 and other spacers shown in FIGS. 6 and 7 to the outer surface 134 of the wall 124 in positions to space the wall panel 102 apart from the outer surface 134 of the wall 124 at locations spaced apart from the side edges 116, 118, 120, and 122 of the wall panel 102;
6. applying adhesive, such the acrylic or rubberized two-sided adhesive tape known as "3M™ VHB™ permanent assembly tape" for example, to the contact flanges of two middle spacers;
7. positioning the wall panel 102 such that a retaining surface of the wall panel 102 is retained behind the retainer 254 of the fastening body 250, such that another retaining surface of the wall panel 102 is retained behind the retainer 262 of the fastening body 260, and such that the inner surface 114 of the wall panel 102 is adhered to the contact flanges of the spacers 136 and 138;
8. coupling the retaining body 152 to the mounting body 154; and
9. coupling the retaining body 242 to the mounting body 244.

In the embodiment shown, the retainers 156, 246, 254, and 262 substantially surround an outer periphery of the wall panel 102, and such retainers may be referred to as "tab over" retainers because the retainers extend over the outer surface 112 of the wall panel 102. The fastener assemblies 150 and 230 and the fastener bodies 250 and 260 advantageously have sufficient structural strength to fasten the wall panel 102 to the wall 124 independently of any fasteners through the wall panel 102. The fastener assemblies 150 and 230 and the fastener bodies 250 and 260 thus function as "primary" fasteners that fasten the wall panel 102 to the wall 124 to resist gravitational forces and wind loads, for example, on the wall panel 102. Although the embodiment shown includes an adhesive to adhere contact flanges of the spacers 136 and 138 to the inner surface of the wall panel 102, such an adhesive is not required to fasten the wall panel 102 to the wall 124, and therefore such spacers and adhesive function as "secondary" fasteners.

Figure 10:
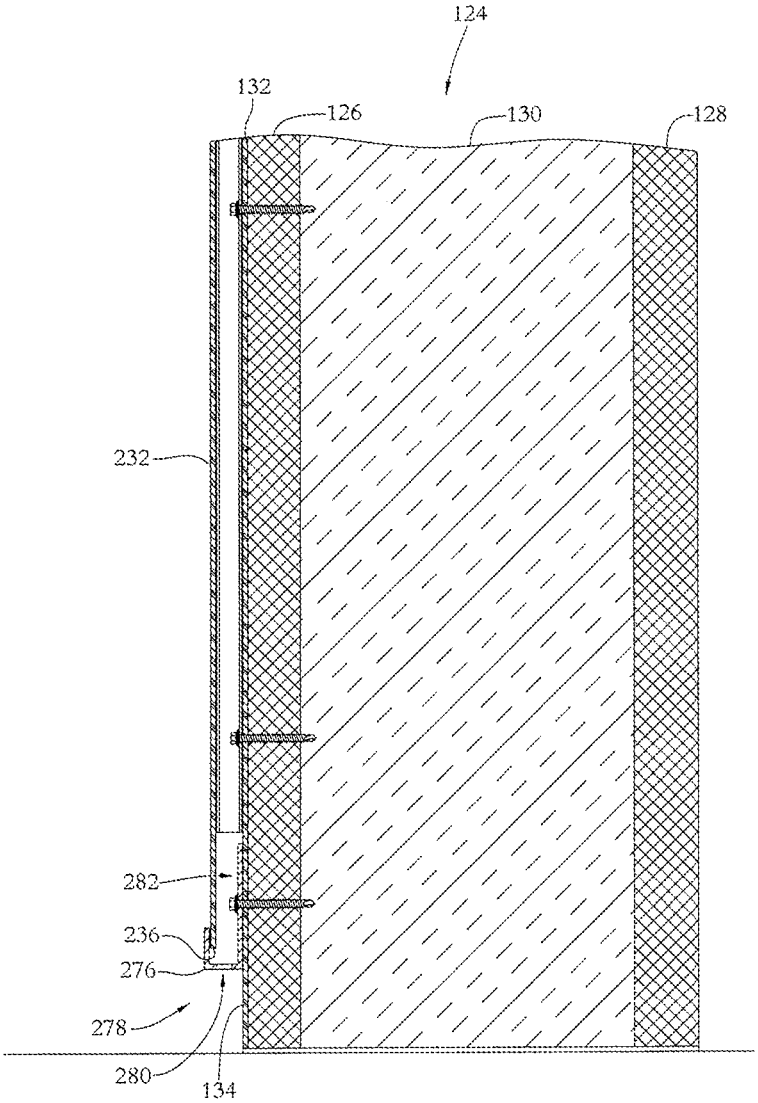
FIG. 10 is a cross-sectional view of the wall system of FIG. 1 taken along the line X-X in FIG. 1.

Referring to FIGS. 1 and 10, the wall assembly 100 further includes a fastening body 276, which is substantially the same as the fastening body 260 but is cut to a desired length to fit in the wall assembly 100 and is mounted on the outer surface 134 of the wall 124 adjacent the bottom side edge 236 of the wall panel 232. Again, "adjacent" in this context includes a space to permit thermal expansion of the wall panel 232. However, in other embodiments, the bottom side edge 236 of the wall panel 232 may contact the fastening body 276 to transfer some or all of the weight of the wall panel 232 onto the fastening body 276. In such embodiments, thermal expansion and contraction may be accommodated at spaces surrounding the other side edges of the wall panel 232. Further, a bottom side shown generally at 278 of the fastening body 276 defines through-holes such as the through-hole shown generally at 280 to permit any moisture that may accumulate in a space shown generally at 282 between the wall panel 232 and the outer surface 134 of the wall 124 to exit the space 282. Such through-holes may therefore avoid accumulation of moisture in the space 282 and thereby advantageously avoid damage that such moisture may cause to the wall panel 232, to the wall 124, or to both.

Figure 11:
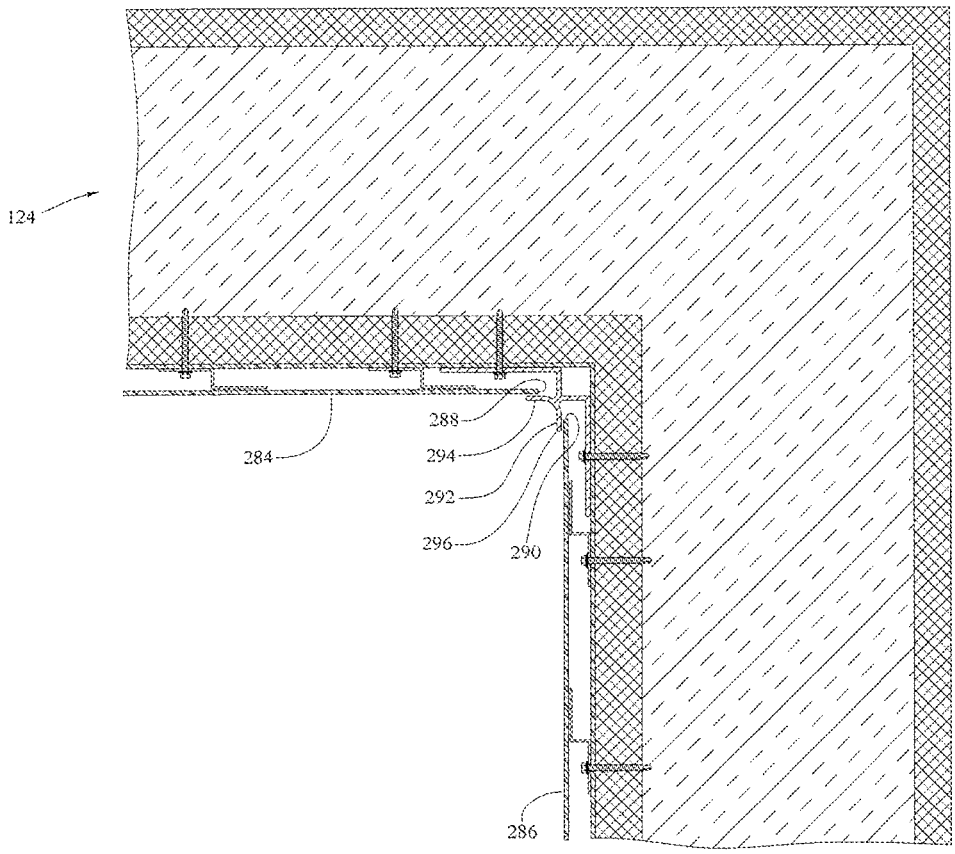
FIG. 11 is a cross-sectional view of the wall system of FIG. 1 taken along the line XI-XI in FIG. 1.

Referring to FIGS. 1 and 11, the wall assembly 100 further includes wall panels 284 and 286 that are generally vertical but perpendicular to each other at an inside corner of the wall 124. The wall panel 284 has a right side edge 288, and the wall panel 286 has a left side edge 290. The wall assembly 100 also includes a fastening body 292 mounted to the wall 124 adjacent the right side edge 288 of the wall panel 284 and adjacent the left side edge 290 of the wall panel 286. Again, "adjacent" in this context includes a space to permit thermal expansion of the wall panels 284 and 286. The fastening body 292 includes an elongate body having retainers 294 and 296 that are also generally vertical but perpendicular to each other to retain respective retaining surfaces on the wall panels 284 and 286 respectively.

The fastening body 292 in the embodiment shown is also an aluminum extrusion cut to a desired length, although alternative embodiments may include mounting bodies formed of other materials having sufficient structural strength to fasten the panels 284 and 286 to the wall 124, such as non-metallic or synthetic materials for example, and by methods other than extrusion. The wall panels 284 and 286 may be mounted to the wall substantially as described above for the wall panel 102, and the fastening body 292 therefore facilitates fastening side edges of wall panels at an inside corner of a wall.

Figure 12:
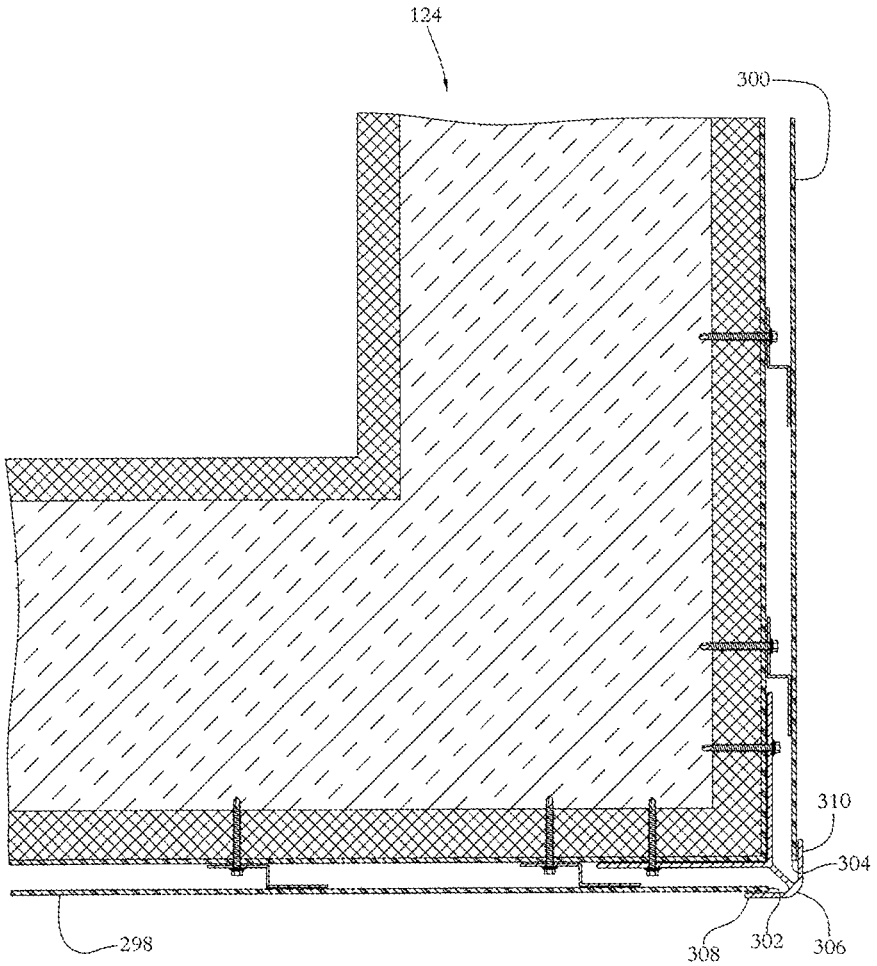
FIG. 12 is a cross-sectional view of the wall system of FIG. 1 taken along the line XII-XII in FIG. 1.

Referring to FIGS. 1 and 12, the wall assembly 100 further includes wall panels 298 and 300 that are also generally vertical but perpendicular to each other at an outside corner of the wall 124. The wall panel 298 has a right side edge 302, and the wall panel 300 has a left side edge 304. The wall assembly 100 also includes a fastening body 306 mounted to the wall 124 adjacent the right side edge 302 of the wall panel 298 and adjacent the left side edge 304 of the wall panel 300. Again, "adjacent" in this context includes a space to permit thermal expansion of the wall panels 298 and 300. The fastening body 306 includes an elongate body having retainers 308 and 310 that are also generally vertical but perpendicular to each other to retain respective retaining surfaces on the wall panels 298 and 300 respectively.

The fastening body 306 in the embodiment shown is also an aluminum extrusion cut to a desired length, although alternative embodiments may include mounting bodies formed of other materials having sufficient structural strength to fasten the panels 298 and 300 to the wall 124, such as non-metallic or synthetic materials for example, and by methods other than extrusion. The wall panels 298 and 300 may be mounted to the wall substantially as described above for the wall panel 102, and the fastening body 306 therefore facilitates fastening side edges of wall panels at an outside corner of a wall.

Figure 13:
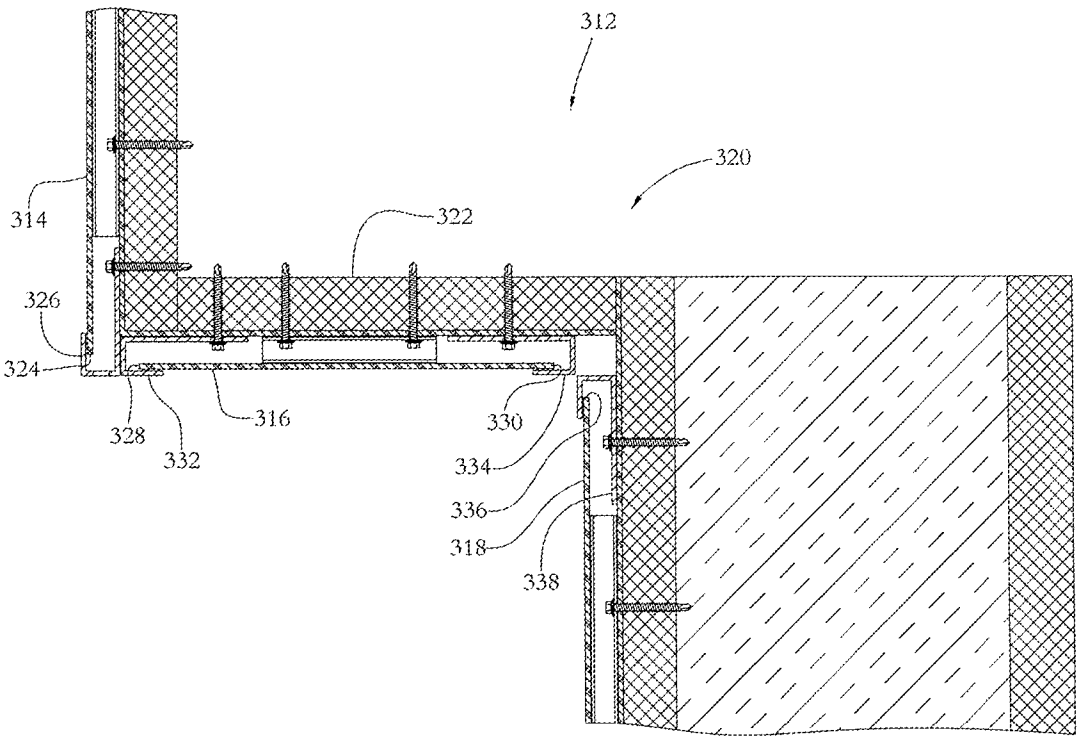
FIG. 13 is a cross-sectional view of a wall system according to another illustrative embodiment.

Referring to FIGS. 1 and 13, a wall assembly according to another illustrative embodiment is shown generally at 312. The wall assembly 312 includes wall panels 314, 316, and 318 fastened to a wall shown generally at 320. The wall 320 includes an overhang 322. The wall panels 314 and 318 are generally vertical and the wall panel 316 is generally horizontal on the overhang 322.

The wall panel 314 has a bottom side edge 324 and is fastened to the wall 320 by a fastening body 326 that is adjacent the bottom side edge 324 of the wall panel 314 and substantially the same as the fastening body 276. The wall panel 316 has a left side edge 328 and a right side edge 330, and the wall panel 316 is fastened to the overhang 322 of the wall 320 with a fastening body 332 adjacent the left side edge 328 and a fastening body 334 adjacent the right side edge 330. The fastening bodies 332 and 334 are substantially the same as the fastening bodies 250 and 260. The wall panel 318 has a top side edge 336 and the wall panel 318 is fastened to the wall 320 by a fastening body 338 that is adjacent the top side edge 336 of the wall panel 318 and substantially the same as the fastening bodies 250 and 260. Again, "adjacent" in this context includes a space to permit thermal expansion of the wall panels 314, 316, and 318. However, in other embodiments, the bottom side edge 324 of the wall panel 314 may contact the fastening body 326 to transfer some or all of the weight of the wall panel 314 onto the fastening body 326. In such embodiments, thermal expansion and contraction may be accommodated at spaces surrounding the other side edges of the wall panel 314. The wall panels 314, 316, and 318 may be fastened to the wall 320 substantially as described above.

In an alternative embodiment not shown, the fastening body 292 (shown in FIG. 11) could be used in place of the fastening bodies 334 and 338 (shown in FIG. 13), and the fastening body 308 (shown in FIG. 12) could be used in place of the fastening bodies 326 and 332 (shown in FIG. 13). However, in general, in embodiments where the fastening bodies 292 and 308 are used horizontally in environments where moisture may accumulate in spaces defined by such fastening bodies, the fastening bodies may be modified to include through-holes (similar to the through-hole at 280 shown in FIG. 10) to permit any moisture that may accumulate in such spaces to exit such spaces.

Referring back to FIG. 1, the wall system 100 also includes an overhang 352 extending away from the wall 124 over a top edge of door 354. The overhang 352 includes various wall panels that are substantially the same as the wall panels described above, but cut to various sizes for the overhang 352. For example, FIG. 1 illustrates a left side wall panel 356, a front side wall panel 358, and a bottom side wall panel 360. The various wall panels are fastened to the overhang 352 substantially as described above, although outer corners of the overhang 352 include outer corner fastening bodies such as an outer corner fastening body 362 at an outer corner of the overhang 352 near corners of the wall panels 356, 358, and 360.

Figure 14:
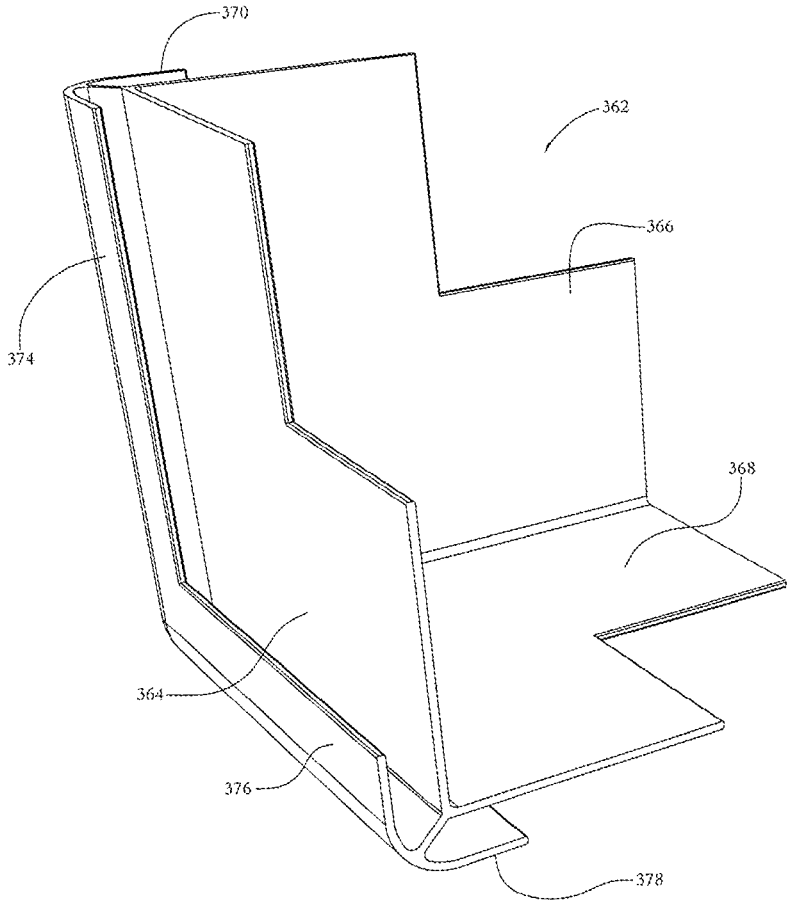
FIG. 14 is an oblique view of a fastening body of the wall system of FIG. 1.
Figure 15:
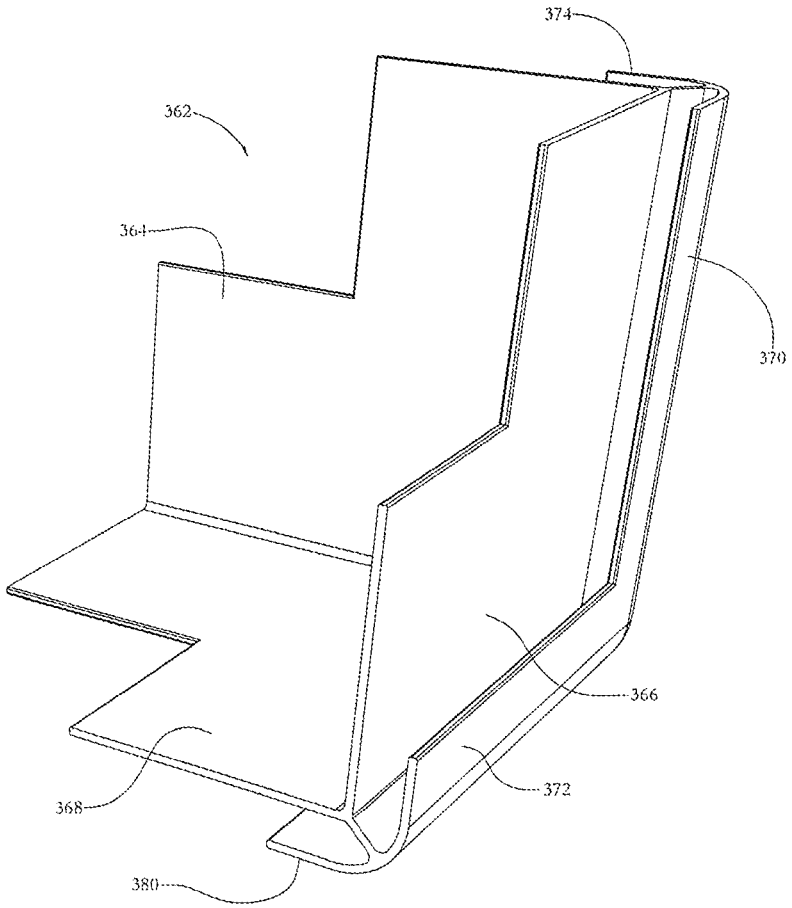
FIG. 15 is another oblique view of the fastening body of FIG. 14.

Referring to FIGS. 1, 14, and 15, the fastening body 362 includes three generally planar and mutually perpendicular mounting flanges 364, 366, and 368 that are mountable to respective portions of an outer surface of the overhang 352 using fasteners as described above, although alternatively the fastening body 362 may be mounted to the overhang by other methods, such as by clipping or snapping to adjacent fastening bodies for example. Further, the fastening body 362 includes generally perpendicular retainers 370 and 372 to contact respective retaining surfaces of the wall panel 356 in the embodiment shown, generally perpendicular retainers 374 and 376 to contact respective retaining surfaces of the wall panel 358 in the embodiment shown, and generally perpendicular retainers 378 and 380 to contact respective retaining surfaces of the wall panel 360 in the embodiment shown. The fastening body 362 thus cooperates with other bodies such as those described above to retain the wall panels 356, 358, and 360 to the overhang 352.

Although the walls shown in the illustrative embodiments described above include plywood panels, walls according to other illustrative embodiments may include other materials. For example, referring to FIG. 16, a mounting body 340 may be mounted to an outer surface 342 of a steel stud 344 of a wall. More generally, the mounting body 340 may be mounted on a horizontal or vertical stud or on a horizontal or vertical Z girt, for example. On a steel stud in some illustrative embodiments, a metal fastener should penetrate the steel stud by at least three thread pitches. A fastener known as an "ITW Buildex Teks™ #10-16" self-drilling and self-tapping screw with a silver climaseal™ coating may be suitable for steel studs.

Figure 17:
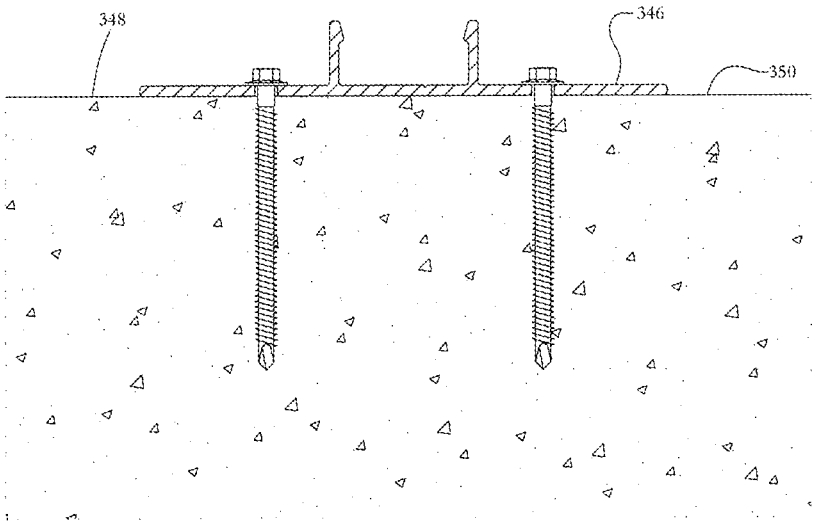
FIG. 17 is a cross-sectional view of a mounting body according to another illustrative embodiment.

Referring to FIG. 17, in still another alternative embodiment, a mounting body 346 may be mounted to an outer surface 348 of a concrete wall 350. On a concrete wall in some illustrative embodiments, a fastener should fully penetrate the surface by at least one inch (or at least 2.54 cm) not including the screw point. A fastener known as a ¾ inch "Hilti Kwik Con II+™ anchor" in 410 stainless steel (into 2000-psi minimum concrete strength) may be suitable for concrete walls.

Figure 16:
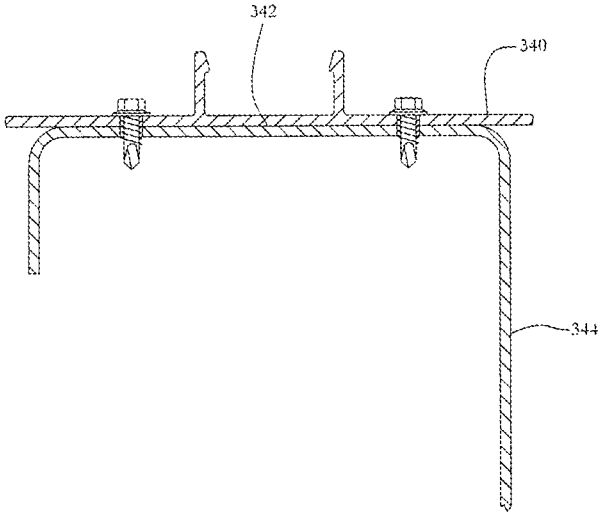
FIG. 16 is a cross-sectional view of a mounting body according to another illustrative embodiment.

Although only mounting bodies are shown in FIGS. 16 and 17, it will be appreciated that more generally the wall assemblies described above may include wall panels mounted so concrete or steel-stud walls, or more generally other walls.

In general, maximum spacing between fasteners on a mounting flange of a mounting body on various substrates may depend on wind pressure in the environment of the wall statistically averaged over a number of years. The table below shows some illustrative guidelines for maximum spacings (in inches) between fasteners on a mounting flange of a mounting body mounted on ½ inch plywood, ½ inch oriented strand board, 18 gauge steel stud, and concrete substrates for various design wind pressures expressed in pounds per square foot (PSF) and kilo Pascals (kPa). For example, a design wind pressure may be determined by a building code, and may be a wind pressure of an hourly wind speed that has a chance of 1-in-50 of being exceeded in any given year, plus a factor to account for a height of the wall and other modifications based on local topographical conditions, building construction, and building height. The table below is to be used as a guideline only, and not for engineering purposes. In some illustrative embodiments, fasteners on opposite sides of a body (such as the opposite mounting flanges 188 and 190 for example) should be staggered along the length of such a body.

| Wind Pressure | | Substrate | | | |
|---|---|---|---|---|---|
| | | ½ inch | ½ inch oriented | 18 gauge | |
| PSF | kPa | plywood | strand board | steel stud | Concrete |
| 20 | 0.96 | 24.00 | 24.00 | 24.00 | 24.00 |
| 25 | 1.20 | 19.20 | 19.20 | 24.00 | 24.00 |
| 30 | 1.44 | 16.00 | 16.94 | 24.00 | 24.00 |
| 35 | 1.68 | 13.71 | 14.40 | 24.00 | 20.57 |
| 40 | 1.92 | 12.00 | 12.52 | 22.15 | 18.00 |
| 50 | 2.39 | 9.60 | 9.93 | 16.94 | 14.40 |
| 60 | 2.87 | 8.23 | 8.47 | 14.40 | 12.00 |
| 70 | 3.35 | 7.02 | 7.20 | 12.52 | 10.29 |
| 80 | 3.83 | 6.13 | 6.40 | 11.08 | 9.00 |

Another illustrative embodiment includes a kit including one or more of the aforementioned wall panels, mounting bodies, and retaining bodies. The kit may further include one or more of the aforementioned fastening bodies, one or more of the aforementioned fasteners, or one or more of the aforementioned adhesive. Still further, the kit may include instructions for fastening one of the wall panels to a wall substantially as described above. In various illustrative embodiments, such instructions may include printed words, illustrations, or both, and may include other recorded media or oral instructions.

Wall panels such as those described above were tested against various standards of ASTM International, and results of those tests are summarized in the table below.

| Testing Item | Standard | Results |
|---|---|---|
| Unit weight | ASTM D792 | t3mm = 4.6 kg/m$^2$<br>t4mm = 5.5 kg/m$^2$ |
| Outdoor temperature resistance | ASTM D1654 | No abnormity |
| Thermal expansion | ASTM D696 | $3.0 \times 10^{-5}$/° C. |
| Thermal deformation temperature | ASTM D648 | 115° C |
| Thermal conduction | ASTM 976 | 0.102 kcal/m · hr ° C. |
| Flexural rigidity | ASTM C393 | $14.0 \times 10^5$ |
| Impact resistance | ASTM D732 | 1650 kgf |
| Adhesive strength | ASTM D903 | 0.74 kgf/mm |
| Sound insulating rate | ASTM E413 | 29 dB |
| Flexural elasticity | ASTM D790 | 4055 kg/mm$^2$ |
| Shear resistance | ASTM D732 | 2.6 kgf/mm$^2$ |
| Minimum bending radius | ASTM D790 | ≥300 mm |
| Fire propagation | ASTM E84 | Qualified |
| Smoke developed | ASTM E84 | <45 |
| Wind pressure resistance | ASTM E330 | Passed |
| Properties against water | ASTM E331 | Passed |
| Proprieties against air | ASTM E283 | Passed |

Further, a polyvinylidene fluoride (PVDF) coating of wall panels of wall assemblies as described above was tested against various standards of ASTM International and other standards, and results of those tests are summarized in the table below.

| Testing Item | Standard | Results |
|---|---|---|
| Finish coat thickness | ISO 2360 (CNS8406) | 27.6 μm |
| Gloss | ASTM D523-99 | 20-45% |
| Pencil hardness | ASTM D3363-00 | 2H |
| Toughness | ASTM D4145-83 | 2T no rift |
| Adhesive force | ASTM D3359-97 | 4B |

-continued

| Testing Item | Standard | Results |
|---|---|---|
| Impact resistance | ASTM D2794-93 | >100 kg · cm |
| Abrasion resistance | ASTM D968-93 | 64.6 L/mil |
| Mortar resistance | ASTM 605.2-91 | 24 hrs no blister |
| Humidity resistance | ASTM D714-97 | 3000 hrs no blister |
| Boiling water resistance | ASTM D3359-B | Passed |
| Salt spray resistance | ASTM B117-03 | 3000 hrs no blister |
| Acid resistance | ASTM D1308-87 | No effect |
| Alkali resistance | ASTM D1308-87 | Passed |
| Solvent resistance | ASTM D2248-73 | Passed |
| Color retention | ASTM D2244-93 | ΔE = 0.34 |
| Chalk resistance | ASTM D4214-98 | No chalking |
| Gloss retention | ASTM D2244-93 | 84.2% |

In general, the methods, kits, and wall assemblies described above advantageously involve fastening wall panels to a wall as architectural cladding or siding systems without fasteners such as screws through the wall panels, thereby avoiding problems such as buckling and oil-canning that can be caused by such fasteners through such wall panels. Further, fastening wall panels to a wall as described above may be simpler than other methods because the methods described above do not require separate steps of fastening a wall panel and mounting decorative trim.

For example, the wall assembly 100 requires only five different bodies 152, 250, 276, 292, and 306 to fasten wall panels to the diverse wall shapes described above, and only those five different bodies is advantageously simpler when compared to other wall assemblies. Further, in illustrative embodiments having wall panels of different thicknesses, different spacers may be chosen based on the thicknesses of the wall panels to space the wall panels a desired distance from a wall, but the same five different bodies 152, 250, 276, 292, and 306 may still be used to fasten such wall panels of different thicknesses, thereby advantageously avoiding additional complication that may arise from selecting different fastener assemblies based on the thicknesses of various wall panels.

Still further, because the first connector is on an inner surface of the retaining bodies described above, the retaining bodies described above do not require separate securing elements to secure the retaining bodies to the mounting bodies. Further, because the retaining bodies described above do not require separate securing elements to secure the retaining bodies to the mounting bodies, the retaining bodies advantageously not require a separate component to conceal any such securing elements.

Still further, the methods, kits, and wall assemblies described above advantageously do not require any prefabrication, welding, or sealing. Rather, the wall panels and other components may be cut to desired sizes on site, thereby permitting faster and less expensive installation when compared to methods that require prefabrication, welding, or sealing.

Still further, the spaces behind the wall panels described above advantageously permit venting of such spaces without requiring any structure in addition to the fastener assemblies and spacers described above, and such venting can avoid damaging moisture accumulation. For example, in the illustrative embodiments described above, the retainers may contact the outer surfaces of the wall panel closely enough to limit moisture from entering spaces between the wall panels and the walls, but not so closely to prevent moisture from escaping the spaces between the wall panels and the walls. Wall assemblies as described above may therefore be referred to as "flow-through rain screen systems".

Although specific embodiments have been described and illustrated, such embodiments should be considered illustrative only and not as limiting the invention as construed in accordance with the accompanying claims.

What is claimed is:

1. A wall assembly comprising:

a wall panel having an inner surface facing an outer surface of a wall;

a retainer; and a separator, wherein:

the wall panel is spaced apart from the outer surface of the wall and defines an air space between the outer surface of the wall and an inner surface of the wall panel;

the retainer retains a retaining surface on the wall panel to fasten the wall panel to the wall; and the separator is positioned between the retainer and the wall panel to define a gap between the retainer and the wall panel to allow moisture to escape the air space.

2. The wall assembly of claim 1, wherein the wall panel is fastened to the wall independently of any fastener through the wall panel.

3. The wall assembly of claim 1, further comprising a first retaining body comprising the retainer, an inner surface, and a first connector on the inner surface.

4. The wall assembly of claim 3, further comprising a mounting body mounted on the outer surface of the wall adjacent a side edge of the wall panel and comprising a second connector coupled to the first connector.

5. The wall assembly of claim 3, wherein the first retaining body defines a channel that faces away from the wall and that is in fluid communication with the air space to allow the moisture to escape the air space.

6. The wall assembly of claim 3, wherein the separator comprises a portion of a second retaining body positioned between the retainer and the wall panel to define the gap.

7. The wall assembly of claim 3, wherein the first retaining body defines a channel that faces away from the wall and that is in fluid communication with the air space to allow the moisture to escape the air space.

8. The wall assembly of claim 4, wherein the first retaining body defines a retaining region adjacent the retainer that receives a portion of the wall panel having the retaining surface, and wherein the retaining region has sufficient clearance to receive the portion of the wall panel without requiring lateral movement of the wall panel relative to the wall when the inner surface of the wall panel faces towards the outer surface of the wall, when the mounting body is mounted on the outer surface of the wall, and as the first connector is coupled to the second connector.

9. The wall assembly of claim 4, wherein the mounting body is mounted on the outer surface of the wall horizontally and horizontally spaced apart from at least one adjacent mounting body mounted on the outer surface of the wall.

10. The wall assembly of claim 4, further comprising a spacer separate from the mounting body, mounted on the outer surface of the wall, and spacing the wall panel apart from the outer surface of the wall.

11. The wall assembly of claim 10, further comprising an adhesive adhering, to the spacer, the inner surface of the wall panel.

12. The wall assembly of claim 10, wherein the spacer comprises:

a contact flange contacting the inner surface of the wall panel;

a mounting flange mounted on the outer surface of the wall; and a single web coupling the contact flange to the mounting flange.

13. The wall assembly of claim 6, wherein the first retaining body extends vertically and the second retaining body extends horizontally.

14. The wall assembly of claim 6, wherein the second retaining body defines a channel that faces away from the wall and that is in fluid communication with the air space to allow the moisture to escape the air space.

15. The wall assembly of claim 14, wherein the channel extends between the retainer and the wall.

16. The wall assembly of claim 1, wherein the wall is an exterior wall of a building.

17. The wall assembly of claim 1, wherein the wall is an interior wall of a building.

18. The wall assembly of claim 1, wherein the retaining surface is on an outer surface of the wall panel facing away from the wall.

19. The wall assembly of claim 1, wherein the retainer deforms the wall panel by displacing the retaining surface in a direction towards the wall.

20. A method of fastening a wall panel to a wall, the method comprising:

when an inner surface of the wall panel faces towards an outer surface of the wall with an air space between the outer surface of the wall and the inner surface of the wall panel, and when a separator is between the wall panel and a retainer, positioning the retainer against a retaining surface of the wall panel and against the separator, wherein positioning the retainer against the retaining surface and against the separator comprises:

fastening the wall panel to the wall; and defining a gap between the retainer and the wall panel to allow moisture to escape the air space.

* * * * *